US012269701B2

(12) United States Patent
Fukuhara et al.

(10) Patent No.: US 12,269,701 B2
(45) Date of Patent: Apr. 8, 2025

(54) SHEET PROCESSING APPARATUS, IMAGE FORMING APPARATUS, AND IMAGE FORMING SYSTEM

(71) Applicants: Takuya Fukuhara, Kanagawa (JP); Ken Sawada, Kanagawa (JP); Ryoh Suzuki, Kanagawa (JP); Kentaroh Fukami, Kanagawa (JP); Atsushi Kuriyama, Kanagawa (JP); Yusuke Tanaka, Kanagawa (JP); Yuuki Nakagawa, Kanagawa (JP); Yasuo Ohba, Kanagawa (JP); Akikazu Iwata, Kanagawa (JP)

(72) Inventors: Takuya Fukuhara, Kanagawa (JP); Ken Sawada, Kanagawa (JP); Ryoh Suzuki, Kanagawa (JP); Kentaroh Fukami, Kanagawa (JP); Atsushi Kuriyama, Kanagawa (JP); Yusuke Tanaka, Kanagawa (JP); Yuuki Nakagawa, Kanagawa (JP); Yasuo Ohba, Kanagawa (JP); Akikazu Iwata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 101 days.

(21) Appl. No.: 18/304,590

(22) Filed: Apr. 21, 2023

(65) Prior Publication Data

US 2023/0348223 A1 Nov. 2, 2023

(30) Foreign Application Priority Data

Apr. 27, 2022 (JP) ..... 2022-073289

(51) Int. Cl.
*B65H 39/06* (2006.01)

(52) U.S. Cl.
CPC ..... *B65H 39/06* (2013.01); *B65H 2513/10* (2013.01); *B65H 2513/51* (2013.01)

(58) Field of Classification Search
CPC .. B65H 39/06; B65H 29/145; B65H 2513/51; B65H 2513/10; B65H 45/14; B65H 39/10; B65H 2701/1311; B65H 2301/42194
See application file for complete search history.

(56) References Cited

U.S. PATENT DOCUMENTS

2009/0200725 A1 8/2009 Tamura et al.
2009/0206547 A1 8/2009 Tokita et al.
(Continued)

FOREIGN PATENT DOCUMENTS

JP 2014-125312 7/2014
JP 2019-163165 9/2019

*Primary Examiner* — Jennifer Bahls
(74) *Attorney, Agent, or Firm* — IPUSA, PLLC

(57) ABSTRACT

A sheet processing apparatus includes a sheet conveyance passage, a sheet circulation passage, a first conveyor, a second conveyor, a third conveyor, and circuitry. In the sheet circulation passage, a sheet is circulated to be overlaid with a following sheet in the sheet conveyance passage. The circuitry circulates the sheet in the sheet circulation passage to overlay the sheet with the following sheet conveyed after the sheet in the first sheet conveyance passage, at an upstream position of the first sheet conveyance passage, and adjusts a sheet conveyance speed of the third conveyor to circulate the sheet, based on a reduction amount that is obtained when a preceding amount of a leading end of the following sheet with respect to a leading end of the sheet is reduced while the following sheet is temporarily stopped due to a temporary stop of the first conveyor.

7 Claims, 17 Drawing Sheets

(56) References Cited

U.S. PATENT DOCUMENTS

| | | | | |
|---|---|---|---|---|
| 2009/0258774 | A1 | 10/2009 | Suzuki et al. | |
| 2009/0283961 | A1 | 11/2009 | Saito et al. | |
| 2010/0019435 | A1 | 1/2010 | Fukami | |
| 2010/0148417 | A1 | 6/2010 | Suzuki et al. | |
| 2010/0207314 | A1 | 8/2010 | Hattori et al. | |
| 2010/0237556 | A1 | 9/2010 | Azuma et al. | |
| 2011/0074081 | A1 | 3/2011 | Hirabayashi et al. | |
| 2012/0217693 | A1 | 8/2012 | Fukami | |
| 2014/0054854 | A1* | 2/2014 | Kushida | B65H 29/22 271/306 |
| 2015/0037119 | A1 | 2/2015 | Tanaka et al. | |
| 2015/0307305 | A1* | 10/2015 | Saito | B42C 19/08 271/3.19 |
| 2015/0321871 | A1 | 11/2015 | Nakagawa et al. | |
| 2015/0329308 | A1 | 11/2015 | Iwata et al. | |
| 2015/0329309 | A1 | 11/2015 | Iwata et al. | |
| 2015/0336765 | A1 | 11/2015 | Sawada et al. | |
| 2017/0267483 | A1 | 9/2017 | Sawada et al. | |
| 2017/0341885 | A1 | 11/2017 | Suzuki et al. | |
| 2018/0370751 | A1 | 12/2018 | Sawada et al. | |
| 2019/0284009 | A1* | 9/2019 | Suzuki | B65H 29/145 |
| 2019/0284011 | A1 | 9/2019 | Furuhashi et al. | |
| 2020/0071118 | A1 | 3/2020 | Sawada et al. | |
| 2020/0172367 | A1 | 6/2020 | Tanoue et al. | |
| 2020/0231401 | A1 | 7/2020 | Fukuhara et al. | |
| 2020/0239263 | A1 | 7/2020 | Hirako et al. | |
| 2022/0063953 | A1 | 3/2022 | Tanaka et al. | |
| 2022/0297963 | A1 | 9/2022 | Suzuki et al. | |
| 2023/0024014 | A1 | 1/2023 | Mochizuki et al. | |

* cited by examiner

SHEET PROCESSING APPARATUS, IMAGE FORMING APPARATUS, AND IMAGE FORMING SYSTEM

CROSS-REFERENCE TO RELATED APPLICATION

This patent application is based on and claims priority pursuant to 35 U.S.C. § 119 (a) to Japanese Patent Application No. 2022-073289, filed on Apr. 27, 2022, in the Japan Patent Office, the entire disclosure of which is hereby incorporated by reference herein.

BACKGROUND

Technical Field

Embodiments of the present disclosure relate to a sheet processing apparatus, an image forming apparatus, and an image forming system.

Background Art

Various types of sheet processing apparatuses are known to perform post-processing operations including an alignment operation for aligning a bundle of overlaid sheet-shaped recording media (sheets) and a sheet folding operation for folding a sheet or a bundle of sheets. In addition, various types of image forming apparatuses including a function corresponding to the function of the above-described sheet processing apparatus and a function to form an image on a sheet are known in the art. Further, various types of image forming systems including the sheet processing apparatus and the image forming apparatus with separate housings connected to each other to perform operations of the image forming system.

When overlaying a plurality of sheet to form a sheet bundle, the ends of the plurality of sheets are aligned. For this reason, disclosed is a known technique for overlaying sheets by circulation conveyance after skew of the posture of the sheet with respect to the sheet conveyance direction is corrected.

SUMMARY

Embodiments of the present disclosure described herein provide a novel sheet processing apparatus including a sheet conveyance passage, a sheet circulation passage, a first conveyor, a second conveyor, a third conveyor, and circuitry. The sheet conveyance passage receives a sheet before a following sheet at a given time interval. In the sheet circulation passage, the sheet is circulated to be overlaid with the following sheet in the sheet conveyance passage. The sheet circulation passage includes at least a first sheet conveyance passage, a second sheet conveyance passage, and a third sheet conveyance passage. The first conveyor is disposed in the sheet circulation passage to stop the sheet temporarily and convey the sheet to a downstream side in a sheet conveyance direction in which the sheet is conveyed, to correct a conveyance position of the sheet with respect to the sheet conveyance direction in the first sheet conveyance passage. The second conveyor is disposed in the sheet circulation passage to receive the sheet conveyed by the first conveyor and convey the sheet along the second sheet conveyance passage. The third conveyor is disposed in the sheet circulation passage to receive the sheet conveyed by the second conveyor and convey the sheet along the third sheet conveyance passage to circulate the sheet to the first sheet conveyance passage. The circuitry controls sheet conveyance speeds of the first conveyor, the second conveyor, and the third conveyor to convey the sheet. The circuitry circulates the sheet in the sheet circulation passage to overlay the sheet with the following sheet conveyed after the sheet in the first sheet conveyance passage, at an upstream position of the first sheet conveyance passage, and adjusts the sheet conveyance speed of the third conveyor to circulate the sheet, based on a reduction amount that is obtained when a preceding amount of a leading end of the following sheet with respect to a leading end of the sheet is reduced while the following sheet is temporarily stopped due to a temporary stop of the first conveyor.

Further, embodiments of the present disclosure described herein provide an image forming apparatus including an image former to form an image on a sheet, and the above-described sheet processing apparatus to perform a post-processing operation on the sheet.

Further, embodiments of the present disclosure described herein provide an image forming system including an image forming apparatus that includes an image former to form an image on a sheet, and the above-described sheet processing apparatus coupled to the image forming apparatus.

BRIEF DESCRIPTION OF THE SEVERAL VIEWS OF THE DRAWINGS

Exemplary embodiments of this disclosure will be described in detail based on the following figures, wherein.

Figure 1:
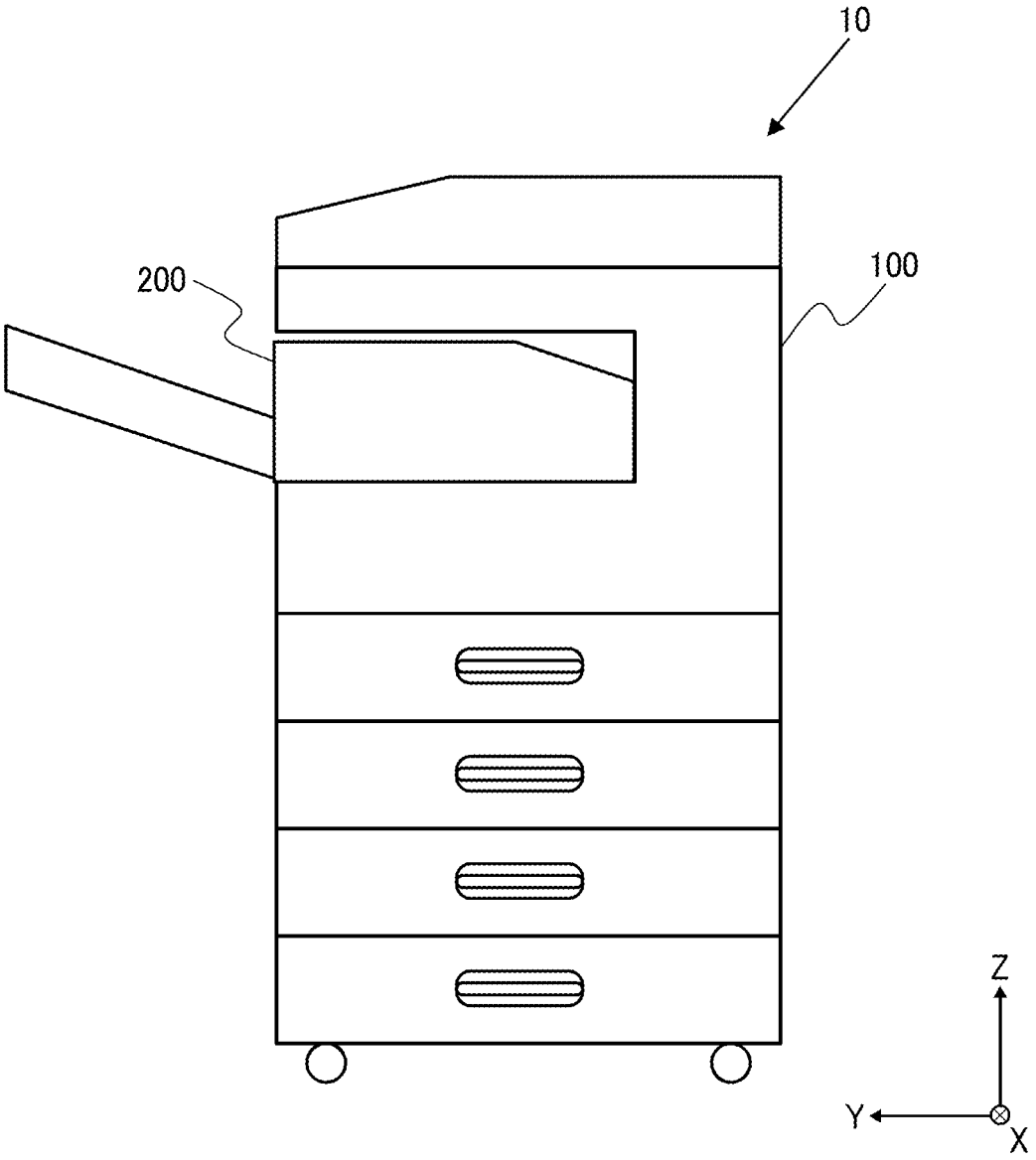
FIG. 1 is a side view of an image forming apparatus according to an embodiment of the present disclosure, where the image forming apparatus includes a sheet processing apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. As used herein, the term "connected/coupled" includes both direct connections and connections in which there are one or more intermediate connecting elements. Like numbers refer to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Embodiment of Image Forming Apparatus

A description is given of an image forming apparatus according to an embodiment of the present disclosure.

FIG. 1 is a side view of a printer 10 serving as an image forming apparatus according to an embodiment of the present disclosure, where the image forming apparatus includes a sheet processing apparatus according to an embodiment of the present disclosure.

The printer 10 according to the present embodiment includes a printer unit 100 serving as an image forming device and a sheet folder unit 200 serving as a sheet processing apparatus. The sheet folder unit 200 cooperates together with the printer unit 100. The printer unit 100 illustrated in FIG. 1 is an in-body ejection type. The printer unit 100 has a feature of making the sheet folder unit 200 selectable as an ejection destination of the recording medium (sheet P) having an image on the surface.

The sheet folder unit 200 serving as a sheet processing apparatus according to an embodiment of the present disclosure has a feature of making a sheet bundle Q that is a plurality of sheets P overlaid with each other. As described below, the sheet folder unit 200 includes a circulation mechanism that circulates and overlays the sheets P to make the sheet bundle Q. The internal configuration of the sheet folder unit 200 to execute the features is described below.

Embodiment of Image Forming System

Figure 2:
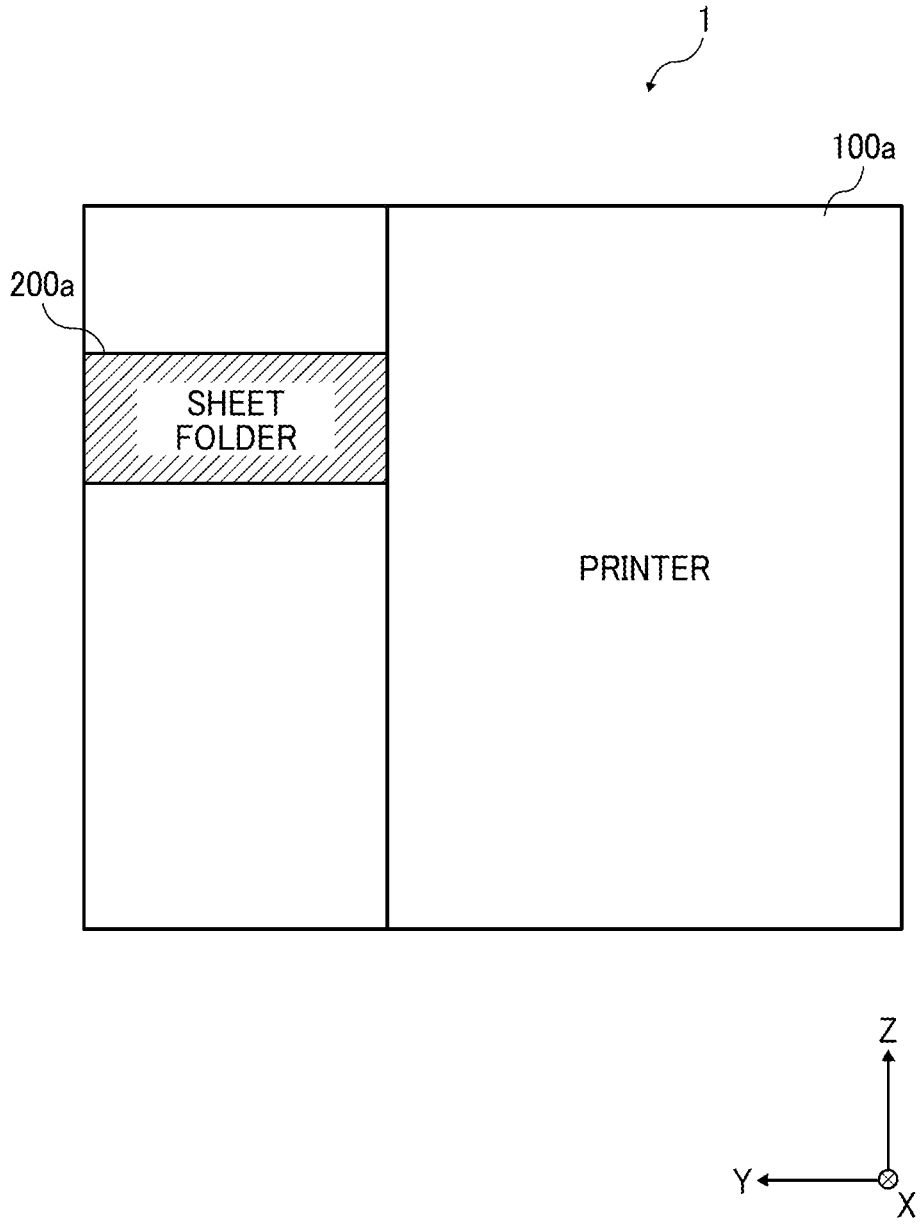
FIG. 2 is a diagram illustrating a schematic configuration of an image forming system according to an embodiment of the present disclosure.

FIG. 2 is a diagram illustrating a schematic configuration of a printer system 1 serving as an image forming system according to an embodiment of the present disclosure.

The printer system 1 according to the present embodiment includes a printer 100*a* and a sheet folder 200*a* serving as a post-processing apparatus coupled to the printer 100*a*. The printer system 1 operates such that the sheets P on which an image is formed by the printer 100*a* is conveyed to the sheet folder 200*a* and a predetermined sheet folding operation is executed on the sheets P in the sheet folder 200*a*.

Functional Configuration of Control Block

Figure 3:
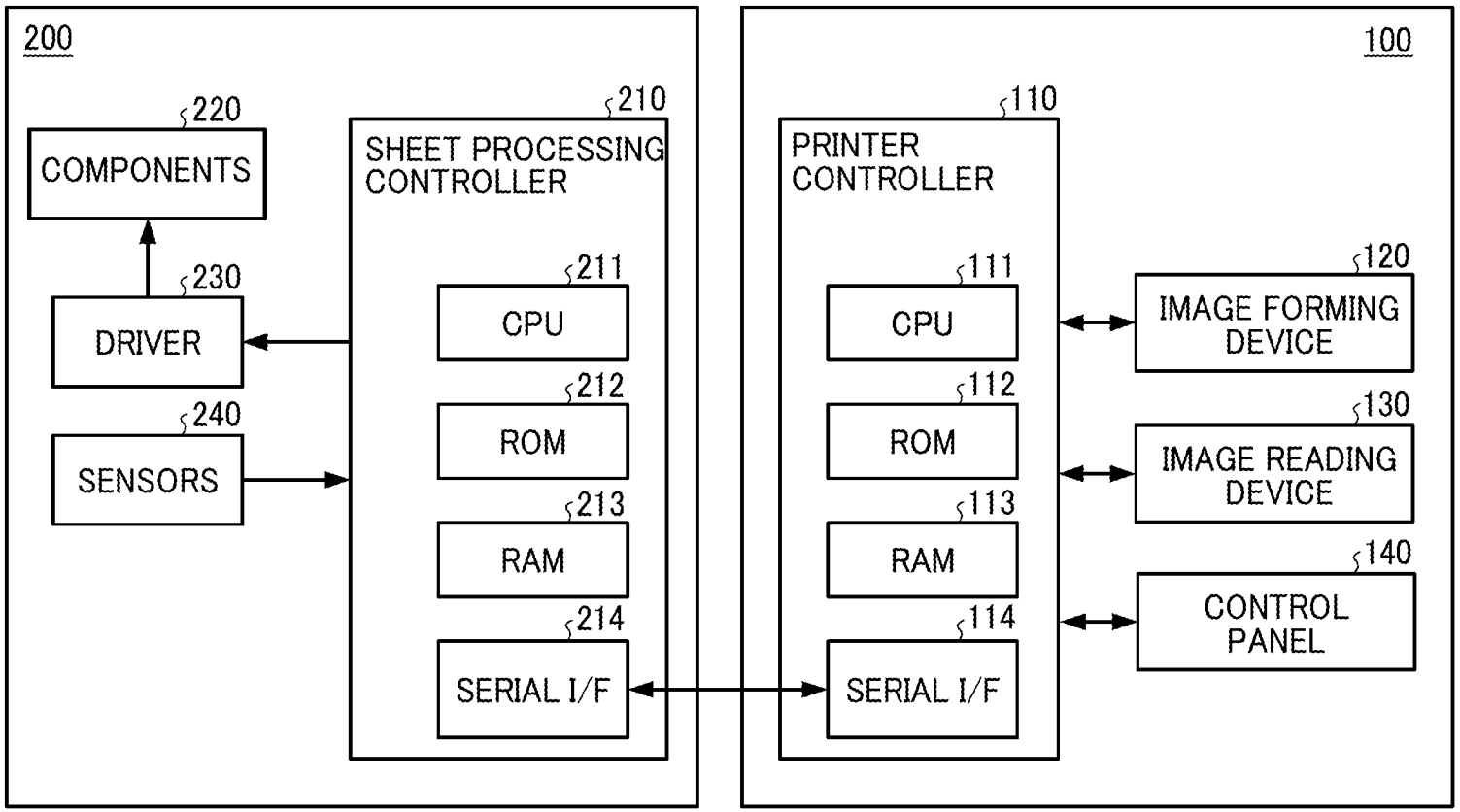
FIG. 3 is a block diagram illustrating a control configuration of the image forming system of FIG. 2.

A description is given of the control block that controls the operations of the printer unit 100 and the sheet folder unit 200 serving as a sheet processing apparatus, according to the present embodiment, with reference to FIG. 3.

FIG. 3 is a block diagram illustrating the control configuration of the printer system 1 as an image forming system of FIG. 2.

As illustrated in FIG. 3, the printer unit 100 includes a printer controller 110 as a control block. The printer controller 110 includes a central processing unit (CPU) 111, a read-only memory (ROM) 112, a random access memory (RAM) 113, and a serial interface (serial I/F) 114.

The printer controller 110 is connected to an image forming device 120, an image reading device 130, and a control panel 140. Each of the image forming device 120, the image reading device 130, and the control panel 140 includes components to fully perform the functions. Each component of the image forming device 120, the image reading device 130, and the control panel 140 operates based on a control signal issued by the printer controller 110.

The image forming device 120 performs an image forming operation based on image data on a sheet P that serves as a recording medium or a sheet-like recording medium. The image reading device 130 reads an image formed on the sheet P and acquires the image data of the image on the sheet P. The control panel 140 serves as an input unit via which operating conditions in the image forming device 120 and the image reading device 130 are input and as a display unit that displays, for example, the operation results.

The control panel 140 also serves as a display unit related to processing contents executed by the sheet processing controller 210 and an input unit that receives input of setting information for controlling the operation (behavior) of the sheet folder unit 200.

The ROM 112 stores control programs for controlling the image forming device 120, the image reading device 130, and the control panel 140. The CPU 111 reads the control programs stored in the ROM 112 to the RAM 113. Then, the CPU 111 stores data in the RAM 113 to use the data for the control and executes the control defined by the control programs while using the RAM 113 as a work area.

As illustrated in FIG. 3, the sheet folder unit 200 includes a sheet processing controller 210 as a control block. The sheet processing controller 210 includes a central processing unit (CPU) 211, a read-only memory (ROM) 212, a random access memory (RAM) 213, and a serial interface (serial I/F) 214.

The sheet processing controller 210 is connected to various components 220 and various sensors 240.

The various components 220 are, for example, rollers and roller pairs (pair of rollers) described below. The rollers and roller pairs corresponding to the various components 220 include sheet conveyance roller pairs and sheet folding roller pairs. A drive motor drives the various components 220. For example, the drive motor drives and rotates various rollers and various roller pairs. The sheet processing controller 210 controls a driver 230 to drive the drive motor that drives the various components 220. The various components 220 performs operations such as conveyance of the sheet P that serves as the recording medium and a sheet folding operation on the sheet P.

The various sensors 240 are a plurality of sheet detectors disposed in the sheet detector conveyance passage in which the sheet P travels and detect the position of the sheet P in the sheet conveyance passage. Details of the conveyance passage are described below. The sheet P and the sheet bundle Q each serves as an object on which the post-processing operation is performed. The sheet processing controller 210 executes the predetermined control program to determine the conveyance amount and position of the sheet P and the conveyance amount and position of the sheet bundle Q based on detection signals output from the various sensors 240 to the sheet processing controller 210. The sheet processing controller 210 calculates the position of the sheet P based on the amount of conveyance (i.e., the distance of conveyance) of the sheet P from when the sheet detector detected the leading end of the sheet P, where the amount of conveyance (i.e., the distance of conveyance) of the sheet P is obtained based on the amount of movement of the various components 220.

The ROM 212 stores the control program for the sheet processing controller 210 to perform predetermined processing. The CPU 211 reads the control programs stored in the ROM 212 to the RAM 213. Then, the CPU 211 stores data in the RAM 213 to use the date for the control and executes the control of the sheet folding operation defined by the control programs while using the RAM 213 as a work area. As described above, the sheet processing controller 210 executes the control program stored in the ROM 212, causes the various sensors 240 to detect the sheet P, and causes the various components 220 to convey the sheet P.

The printer controller 110 provided with the printer unit 100 and the sheet processing controller 210 provided with the sheet folder unit 200 are communicably connected to each other via the serial I/F 114 and the serial I/F 214. This communication path is used to exchange control commands and information to be used, for example, for conveyance control of the recording medium, between the printer controller 110 and the sheet processing controller 210. The sheet folder unit 200 determines whether the conveyance control of a recording medium and the sheet folding operations are performed on the recording medium and switches the kinds of the sheet folding operation, based on the control commands and information related to the recording medium both being sent from the printer unit 100 and information related to the position of the recording medium obtained from the various sensors 240.

The information related to the sheet P that is sent from the printer unit 100 (the printer controller 110) to the sheet folder unit 200 (the sheet processing controller 210) includes a plurality of kinds of information. For example, the information includes the sheet type information of a plurality of sheets such as the kind, thickness, and size of sheet P to be conveyed from the printer unit 100 to the sheet folder unit 200. The information related to the sheet P also includes, for example, information indicating the kind of the post-processing operation (for example, whether the post-processing operation is the sheet folding operation or the sheet overlaying operation), information indicating the number of sheets P included in the sheet bundle on which the sheet folding operation is performed, and information indicating the sheet folding position at which the sheet folding operation is performed on the sheet P. The control commands sent from the printer controller 110 to the sheet processing controller 210 include a command indicating whether the sheet P that is conveyed is the last page (final sheet) in a unit of which the sheets P to be conveyed are collectively processed, in other words, a command corresponding to the "notification of the start of sheet folding".

Embodiment of Sheet Processing Apparatus

A description is given of the internal configuration of the sheet folder unit 200 serving as a post-processing apparatus (sheet processing apparatus) according to a first embodiment of the present disclosure.

Figure 4:
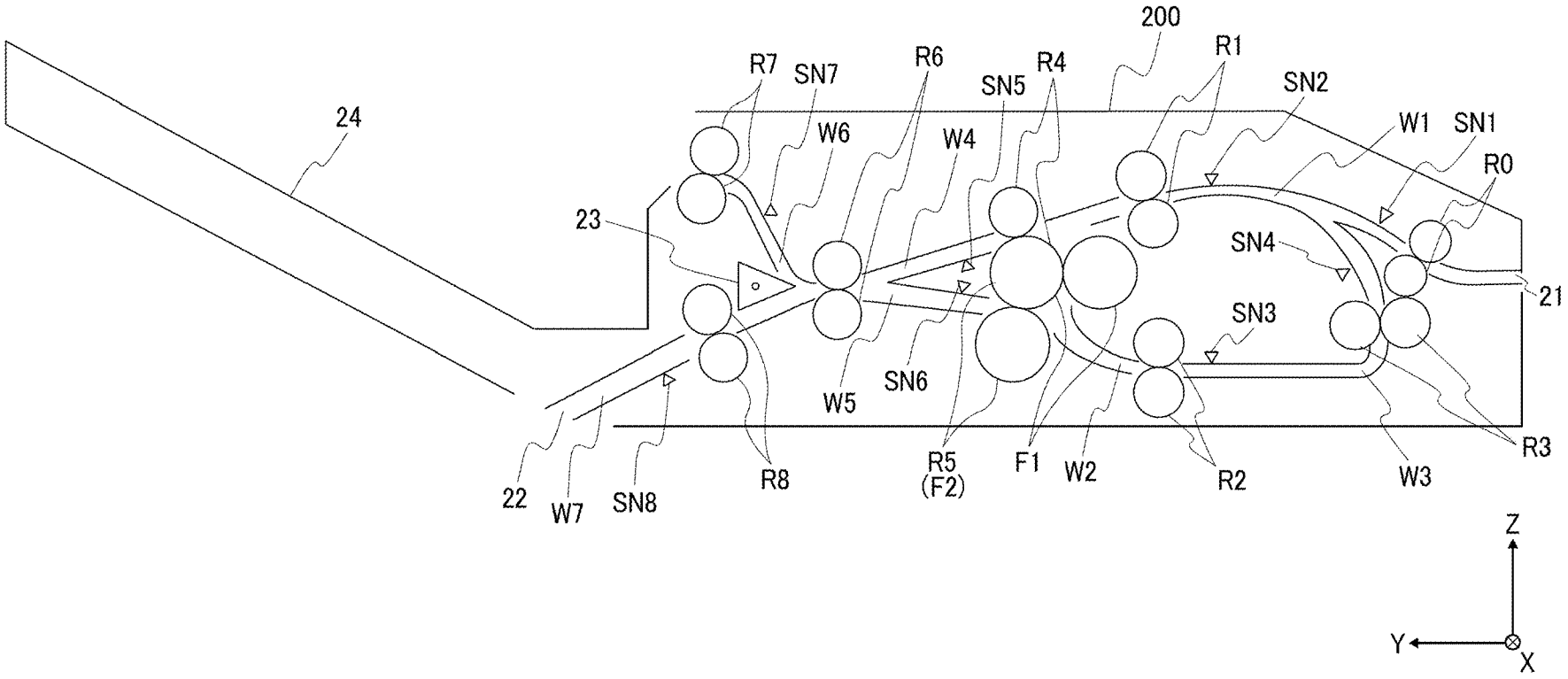
FIG. 4 is a diagram illustrating an internal configuration of a sheet folder unit serving as the sheet processing apparatus according to the present disclosure.

FIG. 4 is a schematic diagram illustrating the internal configuration of the sheet folder unit 200.

The sheet folder unit 200 includes a plurality of sheet conveyors and a plurality of sheet conveyance passages. The plurality of sheet conveyors circulate the sheets P to make the sheets P into the sheet bundle Q. The plurality of sheet conveyance passages are space through which the sheet P and the sheet bundle Q are conveyed by the plurality of sheet conveyors. In addition, a plurality of sheet detection sensors are disposed to detect the position of the sheet P while the sheet P is conveyed in each sheet conveyance passage. Each sheet detection sensor is disposed at the predetermined position at which conveyance of the sheet P and the sheet bundle Q are controlled. Details of the control of conveyance of the sheet P and the sheet bundle Q are described below. Each sheet conveyor includes a conveyance roller pair. In other words, the sheet P and the sheet bundle Q are conveyed in a predetermined direction by each sheet conveying roller pair nipping the sheet P or the sheet bundle Q in the nip region. In addition, the sheet folding operation is performed depending on how the sheet P and the sheet bundle Q are conveyed to the nip region of each sheet conveying roller pair. As a result, the plurality of sheet conveyors also serve as sheet folders.

The sheet folder unit 200 includes seven sheet conveyance passages roughly. As illustrated in FIG. 4, the sheet folder unit 200 includes a first sheet conveyance passage W1, a second sheet conveyance passage W2, a third sheet conveyance passage W3, a fourth sheet conveyance passage W4, a fifth sheet conveyance passage W5, a sixth sheet conveyance passage W6, and a seventh sheet conveyance passage W7.

Plurality of roller pairs are disposed along the first sheet conveyance passage W1, the second sheet conveyance passage W2, the third sheet conveyance passage W3, the fourth sheet conveyance passage W4, the fifth sheet conveyance passage W5, the sixth sheet conveyance passage W6, and the seventh sheet conveyance passage W7. In other words, the plurality of sheet conveyance passages through which the sheet P is conveyed are provided with two rollers included in each of an entrance sheet conveyor R0, a first sheet conveyor R1, a second sheet conveyor R2, a third sheet conveyor R3, a fourth sheet conveyor R4, a fifth sheet conveyor R5, a sixth sheet conveyor R6, a seventh sheet conveyor R7, and an eighth sheet conveyor R8 disposed the predetermined positions. The start and end of rotations of each conveyance roller pair serving as a sheet conveyor are controlled by the control programs executed by the sheet processing controller 210. With this control, the start and end of conveyance of the sheet P are executed.

The sheet folder unit 200 includes a conveyance direction switcher that switches the direction of conveyance of the sheet P. With the conveyance direction switcher, the sheet folder unit 200 according to the present embodiment can execute a plurality of conveying operations on the sheet P that is conveyed from the upstream apparatus in the sheet conveyance direction and travels in the sheet folder unit 200. The conveying operation (performed in a conveyance mode) described below is an operation to switch the direction of conveyance of the sheet P along with the sheet receiving operation of the sheet P.

The sheet folder unit 200 is provided with control functions that perform "ejection conveyance" as the conveyance for ejecting a sheet, "circulation conveyance" as the conveyance for circulating a sheet, and "folding conveyance" as the conveyance for folding sheets. Each of "ejection conveyance", "circulation conveyance", and "folding conveyance" is the conveying operation performed in the sheet folder unit 200 to convey, for example, the sheet P and is executed by the operation of each of the conveyance roller pairs and the operation of the conveyance direction switcher. In other words, the control operation of "ejection conveyance", the control operation of "circulation conveyance", and the control operation of "folding conveyance" is executed under the control of the sheet processing controller 210. Execution of each of the control operations may be switched based on the control command from the printer controller 110.

The ejection conveyance is to convey the sheet P conveyed from the upstream apparatus in the sheet conveyance direction and the sheet bundle Q in which a preceding sheet P that has been conveyed in the sheet folder unit 200 and a following sheet P that is newly conveyed to the sheet folder unit 200 are overlaid with each other are conveyed to a downstream part in the sheet conveyance direction to eject to the outside of the sheet folder unit 200. The "ejection conveyance" is a sheet conveying operation" in which first sheet conveyor R1 conveys the sheet P or the sheet bundle Q in the direction same as the sheet conveyance direction. In other words, the "ejection conveyance" is an operation to convey the sheet P or the sheet bundle Q from the first sheet conveyance passage W1 to the fourth sheet conveyance passage W4 that is downstream from the first sheet conveyance passage W1 in the sheet conveyance direction or from the first sheet conveyance passage W1 to the fifth sheet conveyance passage W5 via the second sheet conveyance passage W2. In other words, when the ejection conveyance is performed, the sheet P or the sheet bundle Q is conveyed from the first sheet conveyance passage W1 toward the exit 22 of the sheet folder unit 200 regardless of whether the sheet folding operation has not been performed on the sheet P or the sheet bundle Q or the sheet folding operation that is performed on the sheet P or the sheet bundle Q has been completed.

The circulation conveyance is a sheet conveying operation to circulate and convey the sheet P or the sheet bundle Q to the upstream side of the first sheet conveyor R1 in the sheet conveyance direction (i.e., the first sheet conveyance passage W1) without changing the leading end of the sheet P or the sheet bundle Q in the sheet conveyance direction when the sheet P or the sheet bundle Q is conveyed along the first sheet conveyance passage W1, in other words, without changing the leading end of the sheet P or the sheet bundle Q in the sheet conveyance direction when the sheet P or the sheet bundle Q is conveyed by the first sheet conveyor R1. In other words, the circulation conveyance is an operation to convey the sheet P or the sheet bundle Q from the first sheet conveyance passage W1 to the second sheet conveyance passage W2 that is downstream from the first sheet conveyance passage W1 in the sheet conveyance direction. In the "circulation conveyance", in order to return the sheet P conveyed to the second sheet conveyance passage W2 to the upstream side of the first sheet conveyance passage W1 in the sheet conveyance direction, the sheet P is conveyed from the second sheet conveyance passage W2 to the third sheet conveyance passage W3, then is circulated from the third sheet conveyance passage W3 to the first sheet conveyance passage W1. The conveyance passage in which the sheet P is circulated is referred to as a "sheet circulation passage". The "circulation conveyance" is performed when the number of sheets P in the sheet bundle Q has not reached the predetermined number of sheets. The circulation conveyance is performed until the number of sheets P in the sheet bundle Q reaches the upper limit number of sheets for the sheet folding operation and the sheet processing controller 210 recognizes the control command of notification of the start of the sheet folding operation.

The "folding conveyance" is a sheet conveying operation to convey the predetermined folding position of the sheet P or the sheet bundle Q to the nip region of the first sheet folder F1. In other words, the "folding conveyance" corresponds to the conveyance in which the first sheet conveyor R1 changes the leading end of the sheet P or the sheet bundle Q in the sheet conveyance direction to convey the sheet P or the sheet bundle Q from the first sheet conveyance passage W1 to the second sheet conveyance passage W2 that is downstream from the first sheet conveyance passage W1 in the sheet conveyance direction. As a result, in the "folding conveyance", a portion of the sheet P or the sheet bundle Q, which is not the leading end of the sheet P or the sheet bundle Q when the sheet P or the sheet bundle Q passes the nip region of the first sheet conveyor R1, serves as the new leading end of the sheet P or the sheet bundle Q in the sheet conveyance direction to convey the sheet P or the sheet bundle Q to the second sheet conveyance passage W2. By so doing, the new leading end of the sheet P or the sheet bundle Q in the sheet conveyance direction passes the nip region of the first sheet folder F1 to form the fold. In other words, the new leading end of the sheet P or the sheet bundle Q in the sheet conveyance direction (i.e., the leading end of the sheet P or the sheet bundle Q conveyed into the second sheet conveyance passage W2) is folded as the fold of the sheet P or the sheet bundle Q. When the second fold is formed, a portion of the sheet P or the sheet bundle Q that is different from the leading end of the sheet P or the sheet bundle Q in the sheet conveyance direction serves as a new leading end of the sheet P or the sheet bundle Q in the sheet conveyance direction to be conveyed to yet another sheet conveyance passage. In the present embodiment, the sheet P or the sheet bundle Q is conveyed to the fifth sheet conveyance passage W5 to form the second fold. As described above, the "folding conveyance" is the conveyance to form a fold on the sheet P or the sheet bundle Q.

The conveyance direction switcher may switch the conveyance direction such that the sheet P or the sheet bundle Q is conveyed from the first sheet conveyance passage W1 to the fifth sheet conveyance passage W5 via the second sheet conveyance passage W2 and the third sheet conveyance passage W3. The conveyance control in this case is also included in the "folding conveyance". As described above, the sheet folder unit 200 includes a plurality of sheet conveyance passages so as to switch between the conveyance in which the leading end of the sheet P or the sheet bundle Q in the sheet conveyance direction is changed and the conveyance in which the leading end of the sheet P or the sheet bundle Q in the sheet conveyance direction is not changed. The sheet folder unit 200 includes a plurality of conveyance direction switchers to perform switching of the plurality of sheet conveyance passages.

Description of Conveyance Direction Switchers

Figure 5:
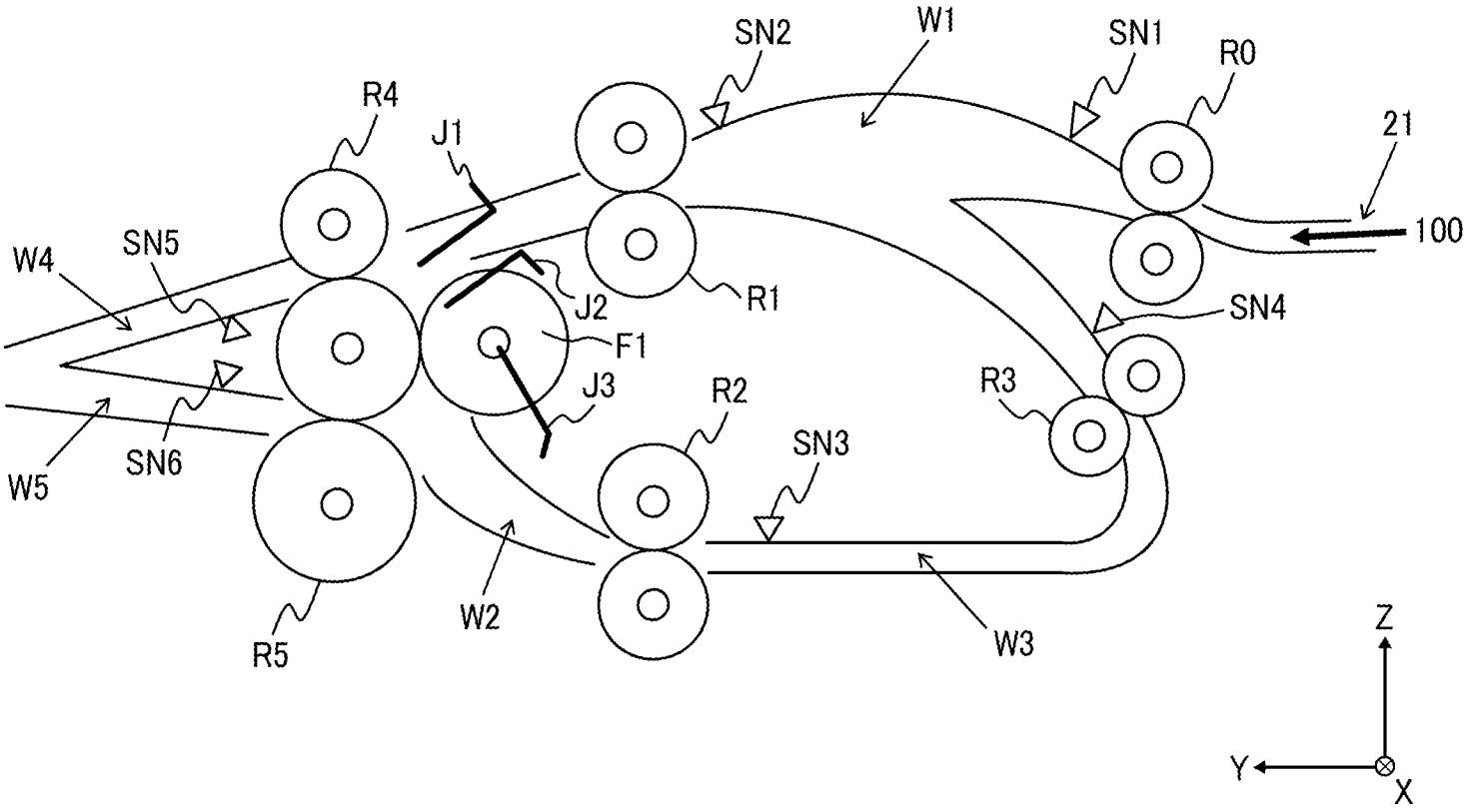
FIG. 5 is an enlarged view of the internal configuration of the sheet folder unit in a process of a folding conveyance.

A plurality of conveyance direction switchers includes, for example, a combination of the first sheet conveyor R1, the fourth sheet conveyor R4, the first sheet folder F1, and the fifth sheet conveyor R5. For example, as illustrated in FIG. 5, the plurality of conveyance direction switchers includes a first switching member J1, a second switching member J2, and a third switching member J3. The plurality of conveyance direction switchers is included in the various components 220 whose operations are controlled by the sheet processing controller 210. As a result, the sheet processing controller 210 controls the operations of the plurality of conveyance direction switchers to control the operations of the sheet conveyors that convey the sheet P and the sheet bundle Q to selectively switch the plurality of sheet conveyance passages. Additionally, the sheet folder unit 200 includes the first sheet folder F1 and a second sheet folder F2 in the sheet circulation passage to perform the sheet folding operation on the sheet P and the sheet bundle Q.

As described below, before the sheet folder unit 200 ejects the sheet P delivered from the printer unit 100 to the exit 22 (see FIG. 4) at the downstream side in the sheet conveyance direction, the sheet folder unit 200 receives the following sheet P and performs the circulation conveyance as a sheet conveying operation on the sheet bundle Q including the preceding sheet P and the following sheet P overlaid with each other or the folding conveyance to perform the predetermined sheet folding operation on the sheet P and the sheet bundle Q.

In the following description, the sheet P conveyed from the printer unit 100 to the sheet folder unit 200 (i.e., the sheet P that is conveyed in the preceding manner) is referred to as a "preceding sheet P1". The sheet P to be conveyed to the sheet folder unit 200 following the preceding sheet P1 to be overlaid with the preceding sheet P1 is referred to as a "following sheet P2". The sheet P to be conveyed to the sheet folder unit 200 following the following sheet P2 to be overlaid with the preceding sheet P1 and the following sheet P2 is referred to as a "second following sheet P3". In addition, a plurality of sheets P overlaid with each other is referred to as a "sheet bundle Q".

The sheet folder unit 200 has the predetermined upper limit to the number of sheets P when the sheet overlaying operation or the sheet folding operation is performed on the sheets P. This upper limit is referred to as an "upper limit sheet number". In the following description, the upper limit sheet number is three. However, the upper limit sheet number of the sheet folder unit 200 according to the present embodiment is not limited to three and may be one, two, four or more.

Description of Sheet Conveyors

The sheet folder unit 200 includes an entrance sheet conveyor R0 serving as an entrance conveyance roller pair proximate to an entrance 21 at which the sheet from the printer unit 100 is received. In response to reception of information that the preceding sheet P1 is ejected from the printer unit 100, the sheet processing controller 210 controls a drive motor that rotates the entrance sheet conveyor R0 to start rotations of the entrance sheet conveyor R0. Then, when the leading end of the preceding sheet P1 reaches the nip region formed by the pair of rollers of the entrance sheet conveyor R0, the entrance sheet conveyor R0 conveys the preceding sheet P1 toward the downstream side in the sheet conveyance direction.

The first sheet conveyor R1 is disposed in the first sheet conveyance passage W1 that is downstream from the entrance sheet conveyor R0 in the sheet conveyance direction and includes a pair of rollers that forms a nip region at which the preceding sheet P1 conveyed from the upstream side is nipped so as to convey the preceding sheet P1 toward the downstream side in the sheet conveyance direction.

The first sheet conveyor R1 also serves as a skew corrector that causes the leading end of the preceding sheet P1 conveyed from the upstream side to contact the nip region to correct the inclination of the posture of the preceding sheet P1 in the sheet conveyance direction. The first sheet conveyor R1 performs skew correction for correcting displacement of the conveyance posture of the sheet P (i.e., the preceding sheet P1) to be conveyed from the entrance sheet conveyor R0 to the first sheet conveyor R1.

When the skew correction is performed, the conveyance roller pair (i.e., the sheet conveyor) is controlled to temporarily stop the rotation performed as a sheet conveying operation or to rotate the conveyance roller pair in reverse, which is a rotational operation opposite to the normal sheet conveying operation.

If the conveyance roller pair included in the first sheet conveyor R1 is reversely rotated during the skew correction, the reverse rotation of the conveyance roller pair is stopped when the preceding sheet P1 contacts the nip region. Then, as the rotation of the conveyance roller pair in the forward direction is started at the predetermined timing to convey the preceding sheet P1, the preceding sheet P1 is conveyed to a further downstream side in the sheet conveyance direction.

The first sheet folder F1 includes a pair of rollers facing each other between the first sheet conveyance passage W1 and the second sheet conveyance passage W2. The pair of rollers of the first sheet folder F1 forms a nip region. Then, the preceding sheet P1 that is guided by the nip region of the first sheet folder F1 passes through the sheet conveyance passage, and then is guided from the first sheet conveyance passage W1 to the second sheet conveyance passage W2. When the preceding sheet P1 passes the first sheet folder F1, the leading end of the preceding sheet P1 in the sheet conveyance direction is not changed at the first sheet conveyor R1. This conveyance control corresponds to the "circulation conveyance". Alternatively, when the preceding sheet P1 is guided by the nip region of the first sheet folder F1 and passes through the sheet conveyance passage, the leading end of the preceding sheet P1 in the sheet conveyance direction is different from the leading end of the preceding sheet P1 when the sheet is conveyed in the sheet conveyance direction by the first sheet conveyor R1. This conveyance control corresponds to the "folding conveyance". The sheet folder unit 200 switches, based on the operations of the plurality of sheet conveyance roller pairs, whether the leading end of the preceding sheet P1 in the sheet conveyance direction when passing the first sheet folder F1 is the same as the leading end of the preceding sheet P1 when passing the nip region of the first sheet conveyor R1 or different from the leading end of the preceding sheet P1 when passing the nip region of the first sheet conveyor R1.

Further, the preceding sheet P1 guided to the second sheet conveyance passage W2 is conveyed to the third sheet conveyance passage W3 by the third sheet conveyor R3 to circulate. Subsequently, the third conveyor R3 temporarily stops the conveyance of the preceding sheet P1 in the third sheet conveyance passage W3.

The conveyance of the preceding sheet P1 that is temporarily stopped in the third sheet conveyance passage W3 is resumed when the sheet folder unit 200 receives the following sheet P2 from the printer unit 100. As a result, the preceding sheet P1 returns to a portion upstream from the first sheet conveyor R1 in the first sheet conveyance passage W1 and meets the following sheet P2 to be overlaid with each other at the predetermined position in the first sheet conveyance passage W1. As described above, the circulation conveyance passage is formed.

In the circulation conveyance passage described above, the preceding sheet P1 and the following sheet P2 are overlaid with each other to form the sheet bundle Q. A description is now given of the flow for performing the sheet folding operation (the overlaying operation) on the sheet bundle Q, with reference to FIGS. 4 and 5.

FIG. 5 is an enlarged view of the internal configuration of the sheet folder unit 200 in a process of the sheet folding operation (the sheet overlaying operation) in the folding conveyance.

The sheet folding operation on the sheet bundle Q is typically performed by the first sheet folder F1 that is operated under the control of the sheet processing controller 210 after the sheet processing controller 210 receives the "sheet overlaying operation start instruction" that is sent by the printer controller 110. The sheet bundle Q subjected to the sheet folding operation (the sheet overlaying operation) by the first sheet folder F1 is delivered from the second sheet conveyance passage W2 to the fifth sheet conveyance passage W5 to be ejected. The fourth sheet conveyor R4, the fifth sheet conveyor R5, and the first sheet folder F1 share the same drive motor. The drive motor can rotate in the forward direction and the reverse direction that is opposite to the forward direction. Changing the direction of rotation of the drive motor switches the sheet conveying operations between the circulation conveyance on the sheet bundle Q including the preceding sheet P1 and the following sheet P2 overlaid with each other or the folding conveyance including the sheet folding operation on the sheet bundle Q.

A switching member 23 is disposed downstream from the sixth sheet conveyor R6 in the sheet conveyance direction. The switching member 23 appropriately switches the direction of conveyance of the sheet P (the sheet bundle Q) between a case in which the sheet P (the sheet bundle Q) is guided toward the sixth sheet conveyance passage W6 and a case in which the sheet P (the sheet bundle Q) is guided toward the seventh sheet conveyance passage W7. Changing the position of the switching member 23 achieves the switching of the direction of conveyance of the sheet P (the sheet bundle Q). The position of the switching member 23 may be switched by, for example, a solenoid. The solenoid may be replaced by a driving mechanism including, for example, a motor, a gear, and a cam.

The sheet P having passed through the fourth sheet conveyance passage W4 or the fifth sheet conveyance passage W5 is ejected to and stacked on an ejection tray 24 of the sheet folder unit 200. The seventh sheet conveyance passage W7 is used to deliver the sheet P to a post-processing apparatus when the post-processing apparatus is disposed downstream from the sheet folder unit 200 that is included in an image forming system. The post-processing apparatus performs the post-processing operations including, for example, an alignment operation or a binding operation on the folded sheet P on which the sheet folding operation has been performed or the non-folded sheet P on which the sheet folding operation has not been performed.

A first sheet detection sensor SN1 is disposed downstream from the entrance sheet conveyor R0 in the sheet conveyance direction in the first sheet conveyance passage W1. A second sheet detection sensor SN2 is disposed upstream from the first sheet conveyor R1 in the sheet conveyance direction in the first sheet conveyance passage W1. The second sheet detection sensor SN2 is disposed downstream from the first sheet detection sensor SN1 in the sheet conveyance direction in the first sheet conveyance passage W1.

A third sheet detection sensor SN3 is disposed downstream from the second sheet conveyor R2 in the sheet conveyance direction (when the circulation conveyance is performed) in the third sheet conveyance passage W3 that is included in the sheet circulation passage. A fourth sheet detection sensor SN4 is disposed downstream from the third sheet conveyor R3 in the sheet conveyance direction (when the circulation conveyance is performed) in the third sheet conveyance passage W3.

A fifth sheet detection sensor SN5 is disposed downstream from the fourth sheet conveyor R4 in the sheet conveyance direction (when the ejection conveyance is performed) in the fourth sheet conveyance passage W4 that is included in the conveyance passage of the sheet P in the ejection conveyance. A sixth sheet detection sensor SN6 is disposed downstream from the fifth sheet conveyor R5 in the sheet conveyance direction (when the ejection conveyance is performed) in the fifth sheet conveyance passage W5. A seventh sheet detection sensor SN7 is disposed downstream from the sixth sheet conveyor R6 in the sheet conveyance direction (when the ejection conveyance is performed) in the sixth sheet conveyance passage W6. Further, an eighth sheet detection sensor SN8 is disposed downstream from the eighth sheet conveyor R8 in the sheet conveyance direction (when the ejection conveyance is performed) in the seventh sheet conveyance passage W7.

Example of Sheet Overlaying Operation

The sheet folder unit 200 described above can perform a letter fold-in and a letter fold-out on the overlaid sheets P (the sheet bundle Q).

A description is given of a series of operations in which two sheets P are overlaid with each other to form the sheet bundle Q via the sheet circulation passage.

Figure 6:
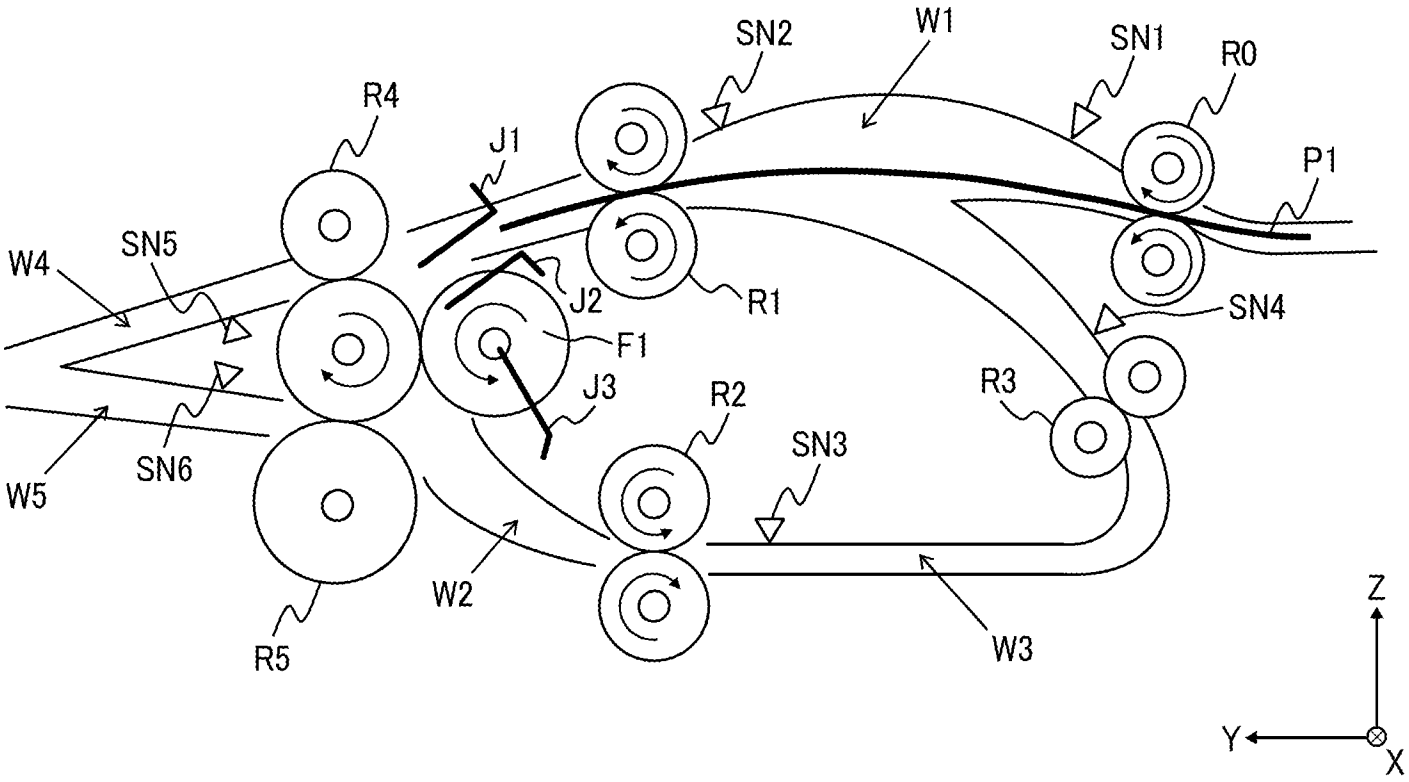
FIG. 6 is an enlarged view of the internal configuration of the sheet folder unit in the subsequent process of the folding conveyance of FIG. 5.

FIG. 6 is an enlarged view of the internal configuration of the sheet folder unit 200 in the subsequent process of the folding conveyance of FIG. 5.

Figure 7:
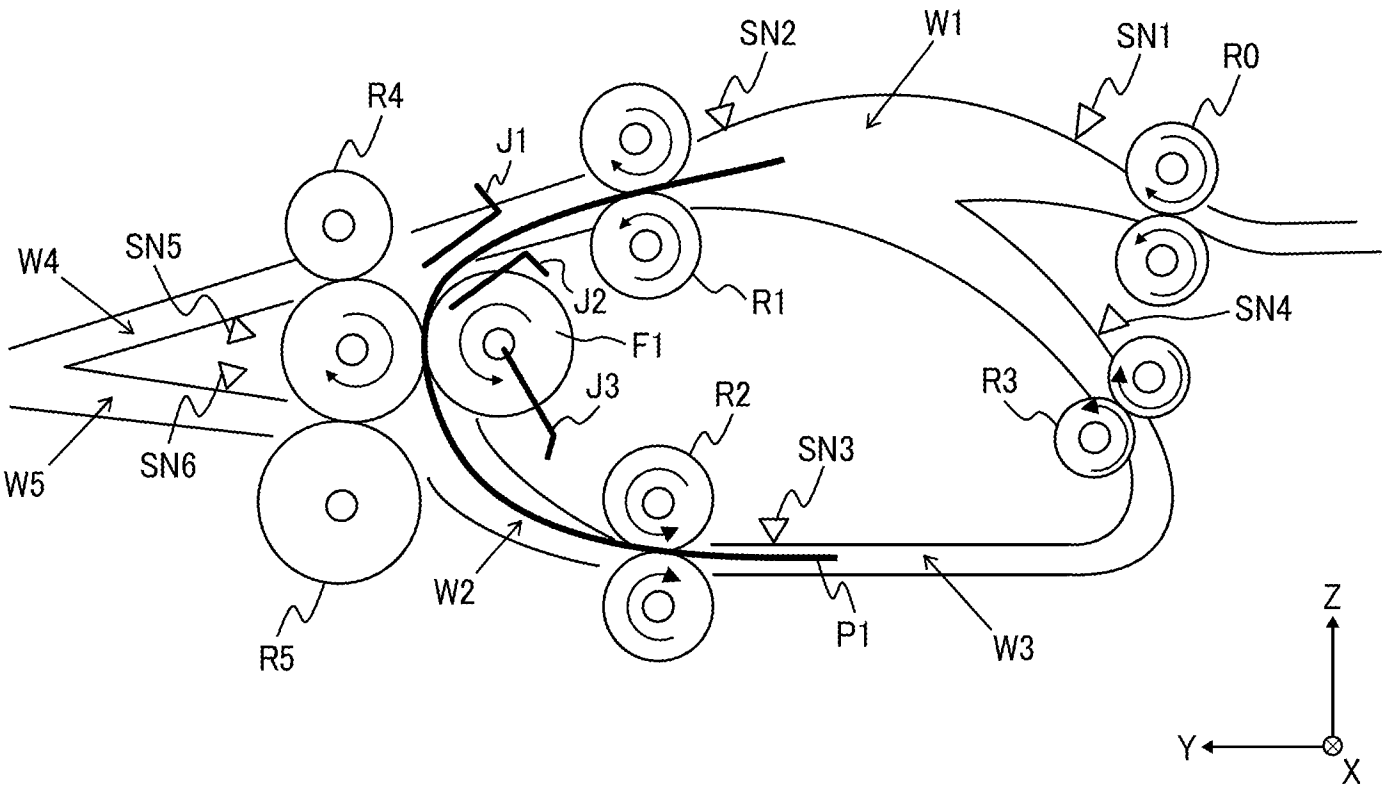
FIG. 7 is an enlarged view of the internal configuration of the sheet folder unit in the subsequent process of the folding conveyance of FIG. 6.

FIG. 7 is an enlarged view of the internal configuration of the sheet folder unit 200 in the subsequent process of the folding conveyance of FIG. 6.

Figure 8:
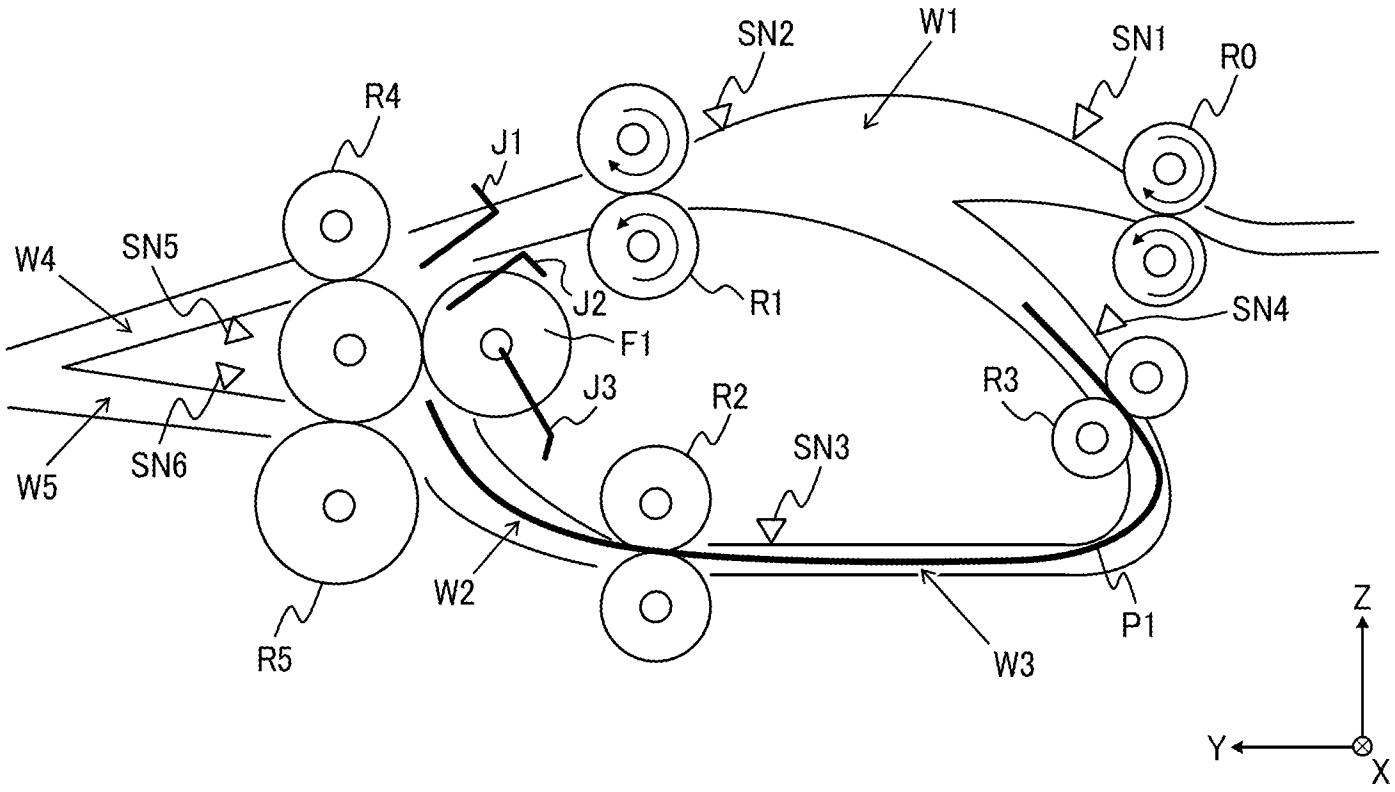
FIG. 8 is an enlarged view of the internal configuration of the sheet folder unit in the subsequent process of the folding conveyance of FIG. 7.

FIG. 8 is an enlarged view of the internal configuration of the sheet folder unit 200 in the subsequent process of the folding conveyance of FIG. 7.

Figure 9:
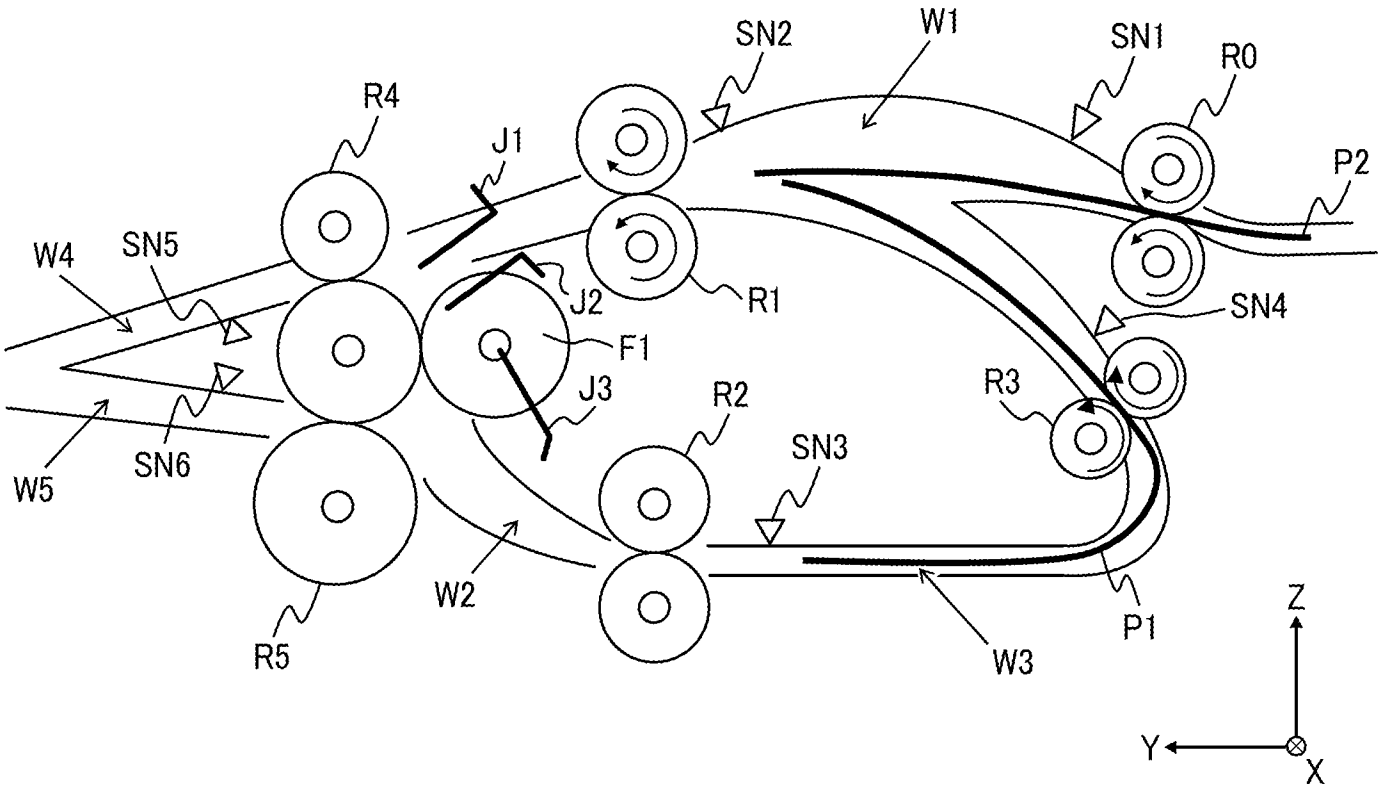
FIG. 9 is an enlarged view of the internal configuration of the sheet folder unit in the subsequent process of the folding conveyance of FIG. 8.

FIG. 9 is an enlarged view of the internal configuration of the sheet folder unit 200 in the subsequent process of the folding conveyance of FIG. 8.

Figure 10:
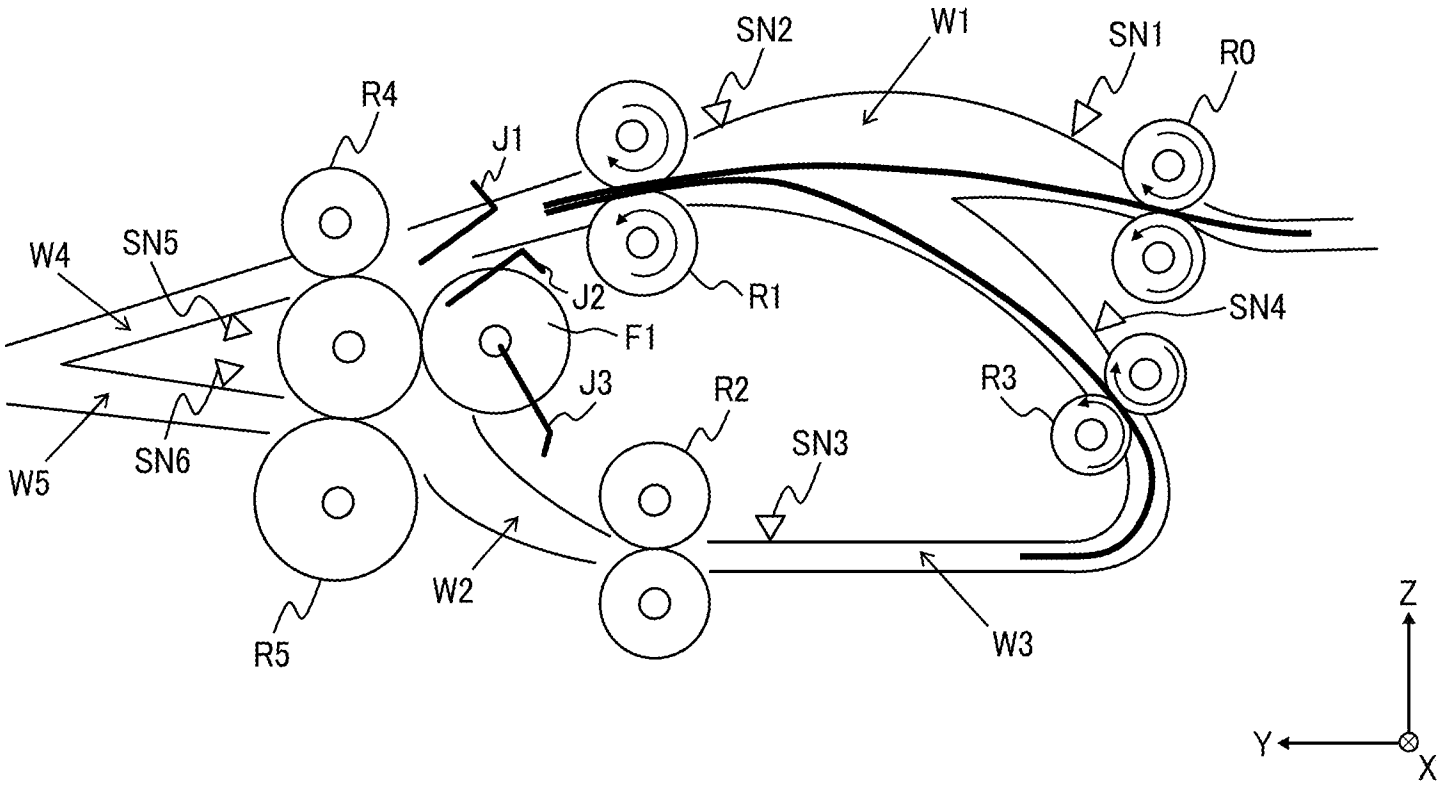
FIG. 10 is an enlarged view of the internal configuration of the sheet folder unit in the subsequent process of the folding conveyance of FIG. 9.

FIG. 10 is an enlarged view of the internal configuration of the sheet folder unit 200 in the subsequent process of the folding conveyance of FIG. 9.

FIG. 5 illustrates the initial state of the sheet folder unit 200 before the sheet P is conveyed from the printer unit 100. In the initial state of the sheet folder unit 200 in FIG. 5, the entrance sheet conveyor R0 starts rotating under the control of the sheet processing controller 210 when the leading end of the preceding sheet P1 that is conveyed from the printer unit 100 reaches the ejection port of the printer unit 100.

As illustrated in FIG. 6, the rotation of the entrance sheet conveyor R0 conveys the preceding sheet P1 to the first sheet conveyance passage W1. The sheet processing controller 210 moves the first switching member J1 to the position illustrated in FIG. 6 not to perform the "ejection conveyance" that guides the preceding sheet P1 to the fourth sheet conveyance passage W4 but to perform the "circulation conveyance" that conveys the preceding sheet P1 to the second sheet conveyance passage W2 and guides the preceding sheet P1 to the sheet circulation passage.

Then, when the leading end of the preceding sheet P1 conveyed by the entrance sheet conveyor R0 is detected by the first sheet detection sensor SN1 that is disposed upstream from the first sheet conveyor R1 in the sheet conveyance direction, the detection signal of the leading end of the preceding sheet P1 is sent to the sheet processing controller 210. After the sheet processing controller 210 receives the detection signal of the leading end of the sheet P (i.e., the preceding sheet P1), the sheet processing controller 210 calculates the timing at which the amount of projection (i.e., the projection amount) reaches the predetermined amount, where the amount of projection (the projection amount) is an amount in which the position of the leading end of the sheet P projects from the nip position of the first sheet conveyor R1 after the receipt of the detection signal of the sheet P. The projection amount of the leading end of the sheet P from the nip position of the first sheet conveyor R1 is referred to as a "first contact amount 41". The sheet processing controller 210 causes the first sheet conveyor R1 to start the rotation at the timing that the projection amount of the leading end of the sheet P reaches the first contact amount Δ1.

At the timing at which the leading end of the preceding sheet P1 enters the nip region of the first sheet conveyor R1, the sheet processing controller 210 rotates the first sheet folder F1, the second sheet conveyor R2, and the third sheet conveyor R3.

By so doing, as illustrated in FIG. 7, the preceding sheet P1 is conveyed to the second sheet conveyance passage W2 by the rotations of the first sheet conveyor R1 and the rotations of the first sheet folder F1, and is then conveyed to the second sheet conveyor R2 along the downward slope of the second sheet conveyance passage W2. The rotations of the second sheet conveyor R2 convey the preceding sheet P1 to the third sheet conveyance passage W3. The preceding sheet P1 conveyed to the third sheet conveyance passage W3 is further conveyed to the downstream side in the sheet conveyance direction by the third sheet conveyor R3. When the fourth sheet detection sensor SN4 detects the leading end of the preceding sheet P1 conveyed by the third sheet conveyor R3, the detection signal is sent from the fourth sheet detection sensor SN4 to the sheet processing controller 210. In response to the detection signal from the fourth sheet detection sensor SN4, the sheet processing controller 210 calculates the time at which the third sheet conveyor R3 conveys the leading end of the preceding sheet P1 from the position of the fourth sheet detection sensor SN4 to the position corresponding to the second projection amount Δ2.

In other words, placing the first switching member J1 at the position as illustrated in FIG. 6 allows the preceding sheet P1 to be conveyed to the downstream side in the sheet conveyance direction without changing the leading end of the preceding sheet P1 in the sheet conveyance direction when the preceding sheet P1 passes the first sheet conveyor R1. With this conveyance control, the circulation conveyance of the preceding sheet P1 is performed.

As illustrated in FIG. 8, when sheet processing controller 210 determines that the leading end of the preceding sheet P1 reaches the position corresponding to the second projection amount 42, the sheet processing controller 210 causes the first sheet folder F1, the second sheet conveyor R2, and the third sheet conveyor R3 to stop rotating to temporarily stop the circulation conveyance of the preceding sheet P1.

Even when the conveyance of the preceding sheet P1 is stopped, the first sheet conveyor R1 continues the rotations to accept the following sheet P2 that is subsequently conveyed from the printer unit 100.

After the detection signal indicating that the leading end of the following sheet P2 is detected by the first sheet detection sensor SN1 is sent to the sheet processing controller 210, as illustrated in FIG. 9, the sheet processing controller 210 continues the conveyance of the following sheet P2 and resumes the conveyance of the preceding sheet P1 at the predetermined time calculated based on the detection timing of the first sheet detection sensor SN1.

As a result, the following sheet P2 and the preceding sheet P1 are overlaid with each other at the predetermined position (i.e., the overlaying position) in the first sheet conveyance passage W1. When the following sheet P2 and the preceding sheet P1 are overlaid with each other, the leading end of the following sheet P2 is placed slightly downstream from the leading end of the preceding sheet P1 in the sheet conveyance direction.

The sheet bundle Q in which the following sheet P2 and the preceding sheet P1 are overlaid with each other is conveyed to the nip region of the first sheet conveyor R1. This timing at which the sheet bundle Q is conveyed to the nip region of the first sheet conveyor R1 corresponds to the timing at which the following sheet P2 reaches the position corresponding to the third projection amount 43 when the leading end of the following sheet P2 meets the preceding sheet P1. In other words, when the leading end of the following sheet P2 reaches the position corresponding to the third projection amount 43, the sheet processing controller 210 causes the second sheet conveyor R2 and the third sheet conveyor R3 to resume the rotations. As a result, as illustrated in FIG. 9, the conveyance of the preceding sheet P1 that has been stopped is resumed.

In this case, the sheet processing controller 210 calculates the timing at which the conveyance of the preceding sheet P1 is resumed, based on the detection by the first sheet detection sensor SN1 without stopping the conveyance of the following sheet P2. When the timing at which the conveyance of the preceding sheet P1 is resumed comes, the sheet processing controller 210 resumes the conveyance of the preceding sheet P1. With this control, the following sheet P2 and the preceding sheet P1 are conveyed in a manner being overlaid with each other.

When the following sheet P2 and the preceding sheet P1 are conveyed in a manner being overlaid with each other, the leading end of the following sheet P2 is placed slightly downstream from the leading end of the preceding sheet P1 in the sheet conveyance direction toward the first sheet conveyor R1.

The sheet processing controller 210 calculates the third projection amount 43 based on the speed of motor (motor speed) that drives the entrance sheet conveyor R0, the speed of motor (motor speed) that drives the third sheet conveyor R3, and the relative positions (relative distances) of the first sheet detection sensor SN1, the second sheet detection sensor SN2, and the fourth sheet detection sensor SN4. The third projection amount Δ3 corresponds to the amount in which the leading end of the following sheet P2 is placed downstream from the leading end of the preceding sheet P1 in the sheet conveyance direction (preceding amount) when the leading end of the preceding sheet P1 and the leading end of the following sheet P2 meet each other before the first sheet conveyor R1.

Then, the leading end of the preceding sheet P1 and the leading end of the following sheet P2 meet each other to form the sheet bundle Q. The sheet bundle Q passes through the nip region of the first sheet conveyor R1 to be conveyed to the downstream side in the sheet conveyance direction, as illustrated in FIG. 10. As described above, the sheet processing controller 210 controls such that the following sheet P2 contacts the nip region of the first sheet conveyor R1 before the preceding sheet P1 contacts the nip region of the first sheet conveyor R1. As a result, when the third projection amount 43 is relatively large in a state in which the preceding sheet P1 and the following sheet P2 have not met each other before the second sheet detection sensor SN2, the timing at which the preceding sheet P1 and the following sheet P2 meet each other can be adjusted.

Then, the sheet processing controller 210 determines whether the set number of sheets to be folded that has been sent from the printer unit 100 matches the number of sheets accepted by the sheet folder unit 200. When the set number of sheets sent from the printer unit 100 matches the number of sheet accepted by the sheet folder unit 200, the sheet folding operation described below is performed. By contrast, when the set number of sheets sent from the printer unit 100 does not match the number of sheet accepted by the sheet folder unit 200, the operations illustrated in FIGS. 7 to 9 are repeated to cause the second following sheet P3 conveyed from the printer unit 100 (i.e., the sheet P after the following sheet P2) to meet the sheet bundle Q so that the second following sheet P3 is overlaid with the sheet bundle Q. Whether the sheet P is conveyed to the position immediately before the nip region of the second sheet conveyor R2 can be determined based on, for example, the number of driving steps of the motor that drives the first sheet conveyor R1. Accordingly, a stepper motor is preferably used as the drive motor to drive and rotate each sheet conveyer. If the drive motor is controlled based on the timing calculated in response to the detection of each sensor, a direct-current motor (DC motor) may be used as the drive motor to drive and rotate each sheet conveyor.

Embodiment of Sheet Folding Operation

A description is now given of the flow of the sheet folding operation in the sheet folder unit 200 according to the present embodiment.

FIGS. 11, 12, 13, and 14 are enlarged views of the internal configuration of the sheet folder unit 200 in the subsequent processes of the folding conveyance in which the sheet bundle Q received from the upstream side in the sheet conveyance direction to form the letter fold-out on the sheet bundle Q.

As described with reference to FIG. 10, the sheet bundle Q including the preceding sheet P1 and the following sheet P2 met with each other is continuously conveyed by the entrance sheet conveyor R0 and the first sheet conveyor R1. When the leading end of the sheet bundle Q enters the nip region of the first sheet conveyor R1, the sheet bundle Q is conveyed toward the fourth sheet conveyor R4.

Figure 11:
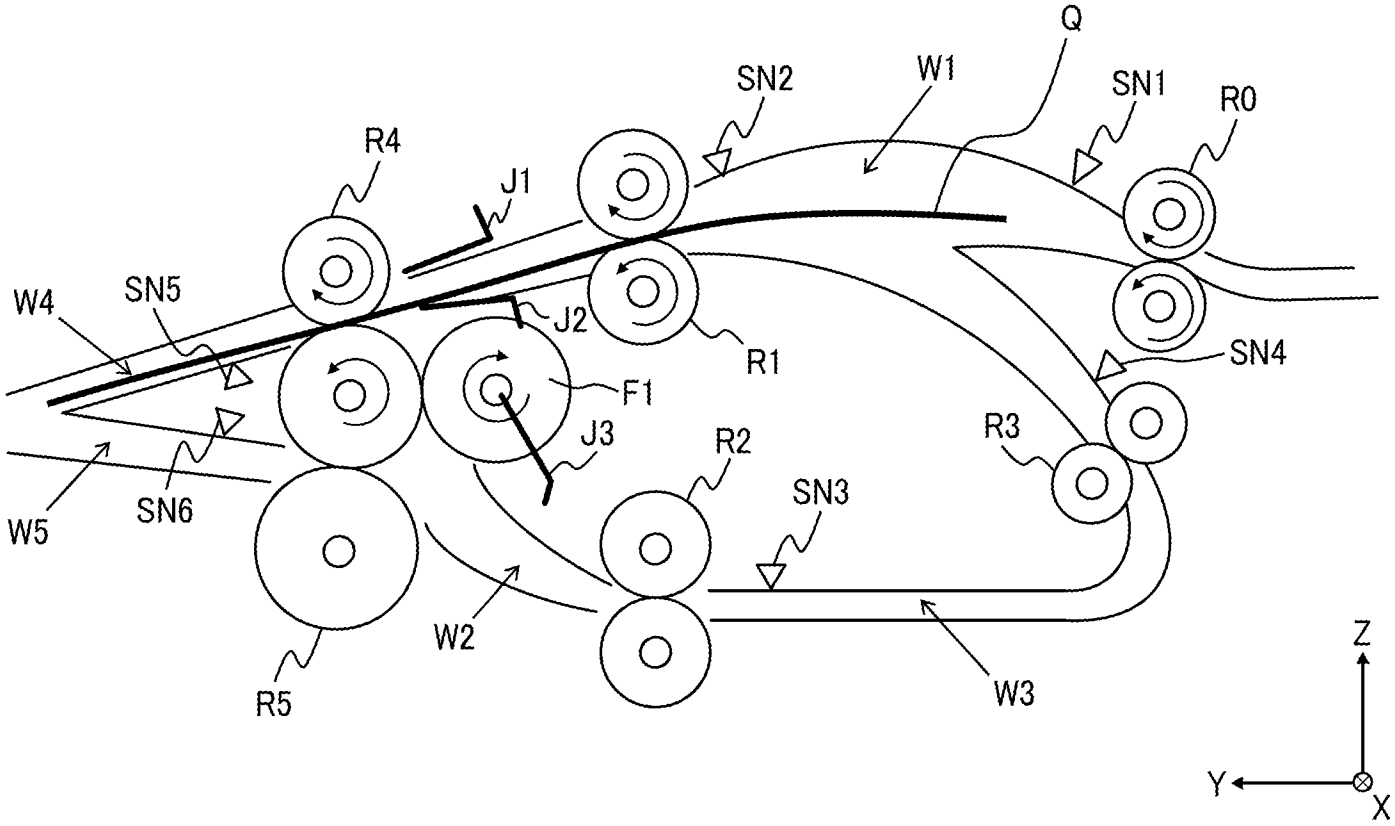
FIG. 11 is an enlarged view of the internal configuration of the sheet folder unit in the subsequent process of the folding conveyance of FIG. 10.
Figure 12:
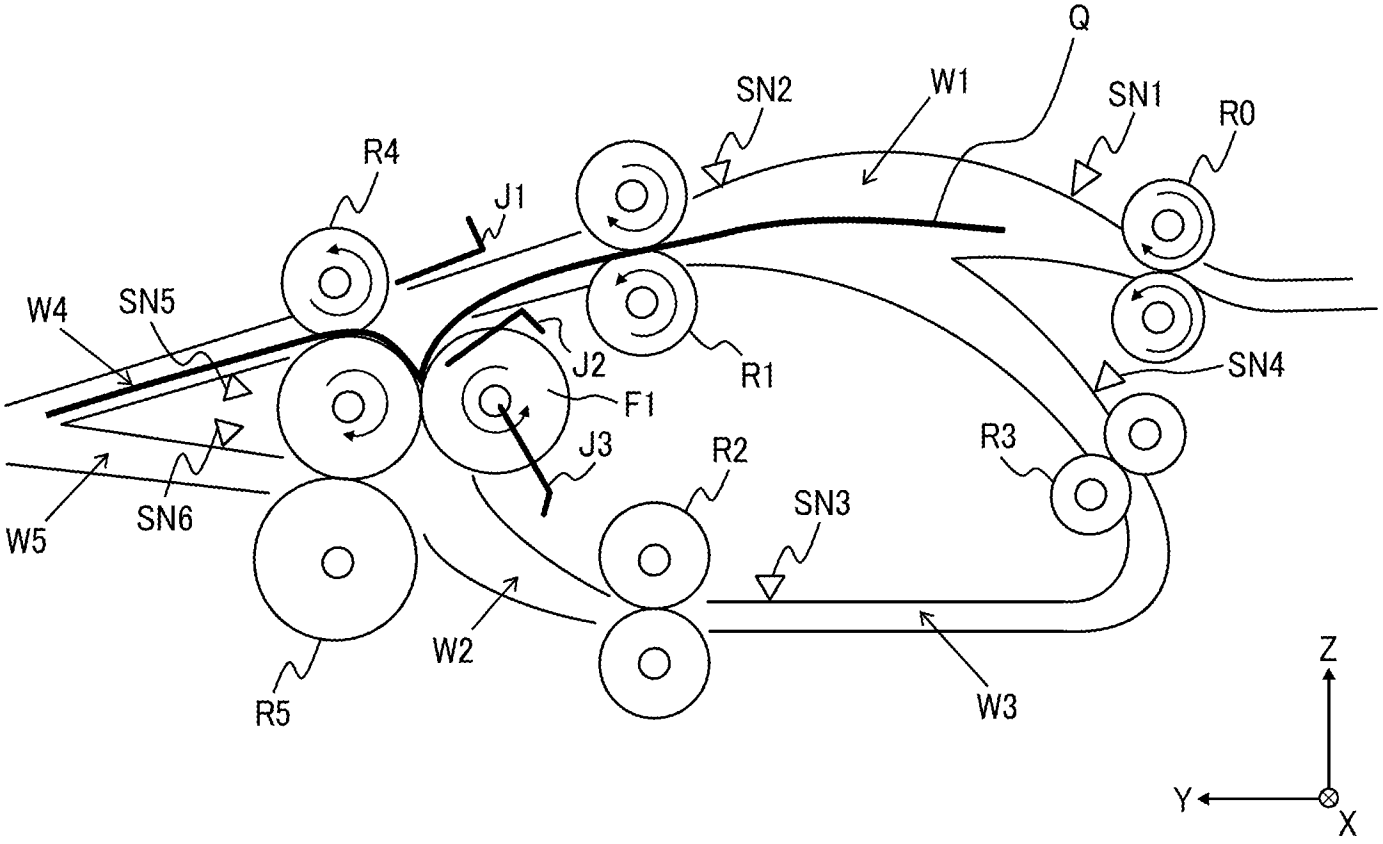
FIG. 12 is an enlarged view of the internal configuration of the sheet folder unit in the subsequent process of the folding conveyance of FIG. 11.

The sheet processing controller 210 starts driving the motor when the sheet bundle Q is conveyed to the position immediately before the nip region of the fourth sheet conveyor R4 so as to rotate the first sheet conveyor R1 and the fourth sheet conveyor R4 in the direction indicated by the arc-shaped arrows in FIG. 11. The sheet processing controller 210 determines the position of the leading end of the sheet bundle Q based on the elapsed time from when the leading end of the sheet bundle Q is detected by the fifth sheet detection sensor SN5. The sheet processing controller 210 causes the first sheet conveyor R1 and the fourth sheet conveyor R4 to further convey the sheet bundle Q. By so doing, the first sheet conveyor R1 and the fourth sheet conveyor R4 continue the conveyance of the sheet bundle Q until the leading end of the sheet bundle Q reaches a fourth projection amount 44 that is the predetermined projection amount from the fifth sheet detection sensor SN5.

When the sheet processing controller 210 determines that the leading end of the sheet bundle Q has reached the fourth projection amount 44, the first sheet conveyor R1 maintains the current rotational direction to convey the sheet bundle Q in the sheet conveyance direction. On the other hand, the sheet processing controller 210 causes the fourth sheet conveyor R4 to rotate in the reverse direction and the first sheet folder F1 to rotate in the reverse direction that is the other direction to the rotational direction of the first sheet folder F1 illustrated in FIG. 7. In other words, the sheet processing controller 210 causes the fourth sheet conveyor R4 and the first sheet folder F1 to rotate in the direction to convey the sheet bundle Q such that the direction of conveyance of the sheet bundle Q is changed to the direction in which the sheet bundle Q is conveyed to the first sheet folder F1 (see FIG. 12). Due to the reverse rotations of the fourth sheet conveyor R4, the conveyance of the sheet bundle Q is changed to the "folding conveyance" in which the first sheet conveyor R1 conveys the sheet bundle Q in the reverse direction that is opposite to the sheet conveyance direction.

Figure 13:
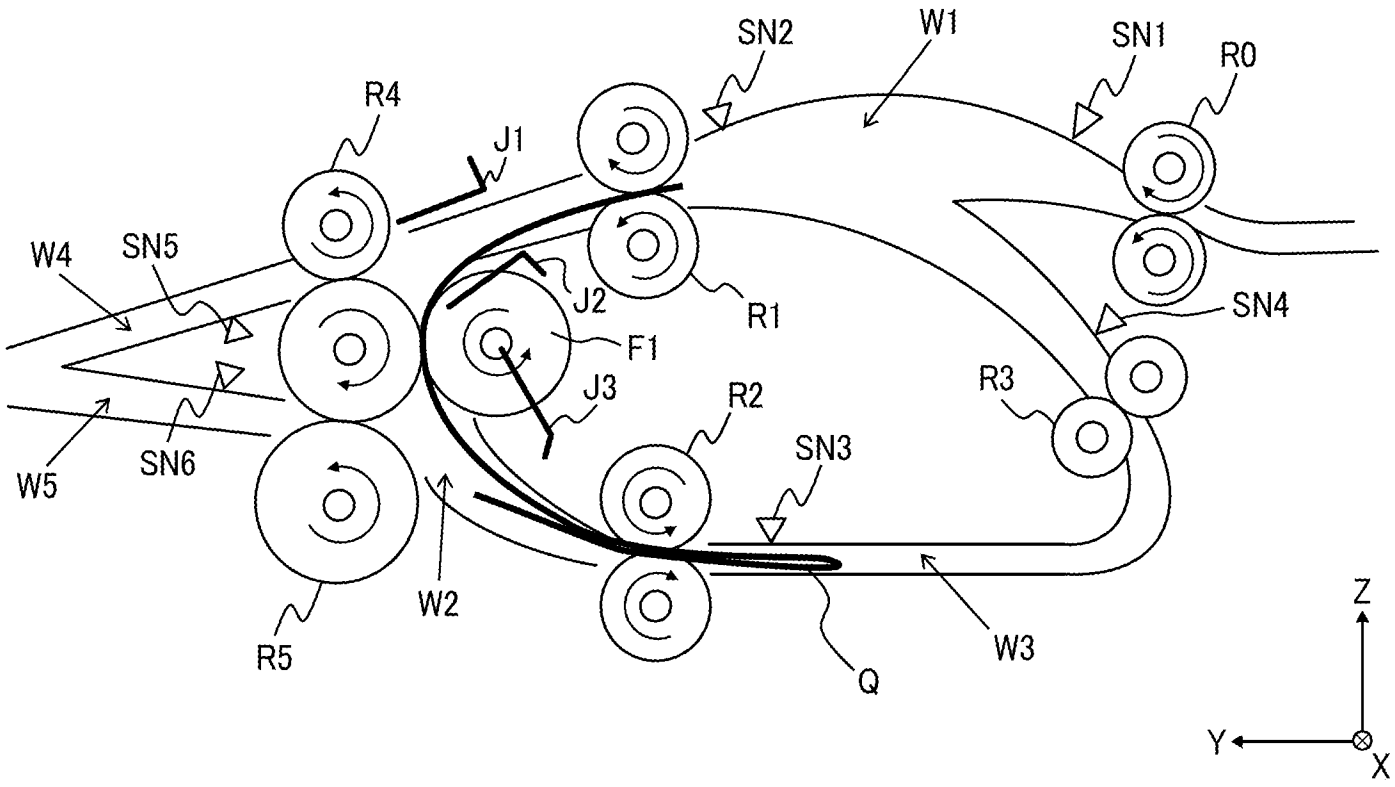
FIG. 13 is an enlarged view of the internal configuration of the sheet folder unit in the subsequent process of the folding conveyance of FIG. 12.

As illustrated in FIG. 13, in the folding conveyance, the first sheet conveyor R1 continues to rotate in the same direction as the rotational direction illustrated in FIG. 9. As a result, the sheet bundle Q forms a bend (to be more specific, a bent portion) before the nip region of the first sheet folder F1. This bend (bent portion) of the sheet bundle Q enters the nip region of the first sheet folder F1 so that a "first folding operation" is performed on the sheet bundle Q. As a result, the first fold is formed in the sheet bundle Q.

The sheet bundle Q on which the first folding operation is performed comes to the circulation conveyance in which the sheet bundle Q is conveyed to the second sheet conveyance passage W2. At this time, the sheet bundle Q is conveyed along the inclination of the downward slope of the second sheet conveyance passage W2, where the third sheet detection sensor SN3 detects the leading end of the sheet bundle Q on which the first folding operation has been performed in the circulation conveyance. The sheet processing controller 210 further conveys the sheet bundle Q in the same direction based on the detection timing of the third sheet detection sensor SN3 and controls the conveyance of the sheet bundle Q so that the leading end of the sheet bundle Q in the sheet conveyance direction comes to have a fifth projection amount 45.

Figure 14:
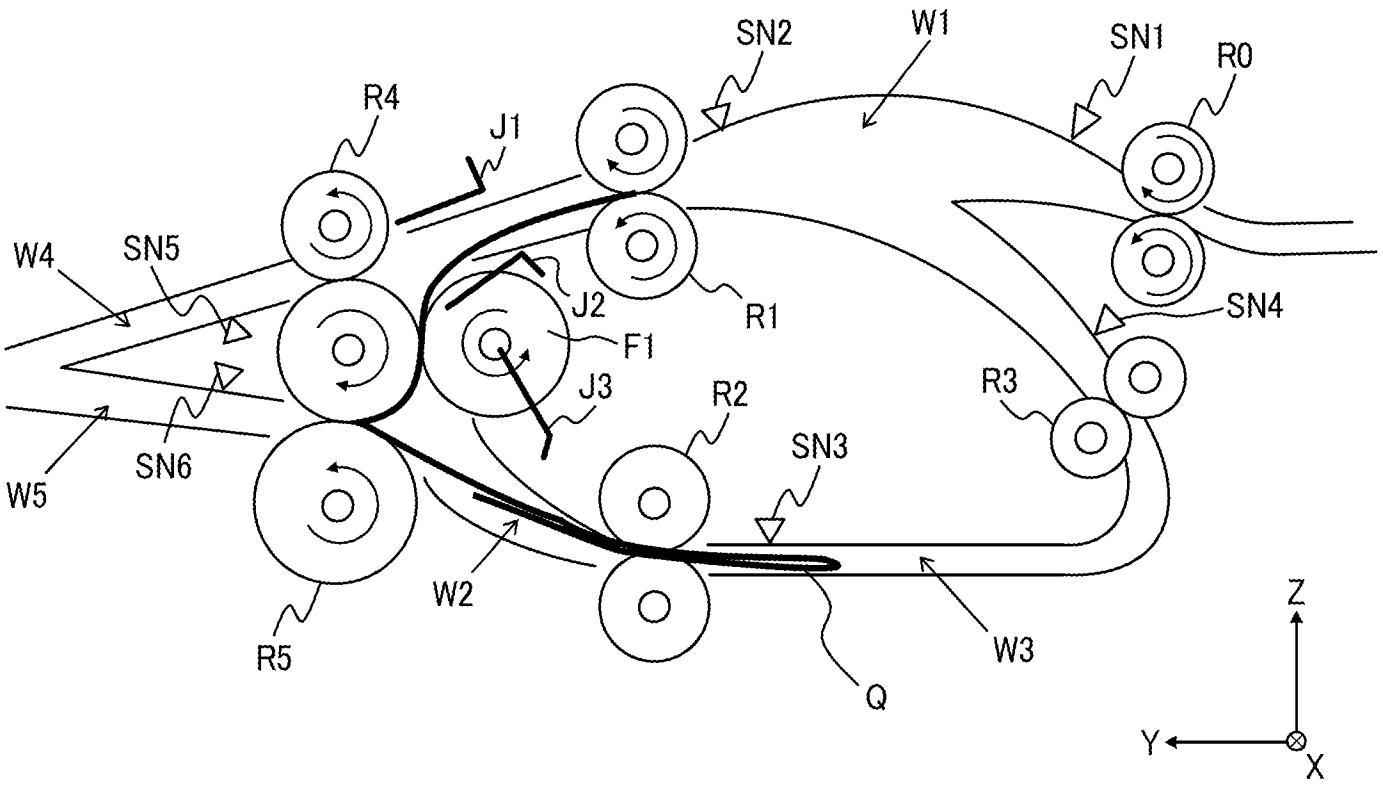
FIG. 14 is an enlarged view of the internal configuration of the sheet folder unit in the subsequent process of the folding conveyance of FIG. 13.

Then, the sheet processing controller 210 causes the second sheet conveyor R2 to rotate in the reverse direction that is opposite to the rotational direction illustrated in FIG. 13 while causing the fourth sheet conveyor R4 and the first sheet folder F1 to rotate in the sheet conveyance direction. This reverse rotation of the second sheet conveyor R2 conveys the sheet P (i.e., the sheet bundle Q) in the reverse direction. On the other hand, the sheet processing controller 210 causes the fourth sheet conveyor R4 and the first sheet folder F1 to continue to rotate in the direction illustrated in FIG. 13 to convey the sheet P (i.e., the sheet bundle Q). As a result, as illustrated in FIG. 14, a bend (bent portion) is formed in the sheet bundle Q before the nip region of the fifth sheet conveyor R5 that also functions as the second sheet folder F2. This bend (bent portion) of the sheet bundle Q enters the nip region of the fifth sheet conveyor R5, so that the fifth sheet conveyor R5 (the second sheet folder F2) performs a second folding operation to form a second fold in the sheet bundle Q.

The sheet bundle Q on which the second folding operation is performed passes through the fifth sheet conveyance passage W5 and is conveyed to the ejection tray 24 (see FIG. 4). The fourth projection amount 44 and the fifth projection amount 45 are determined based on the total length of the sheet P and a folding method set for the sheet P (the sheet bundle Q). Based on this setting, the sheet processing controller 210 determines the fourth projection amount 44 and the fifth projection amount 45 depending on the amount of rotations of the second sheet conveyor R2 (i.e., the number of driving steps of the drive motor).

When the sheet folder unit 200 performs the letter fold-out operations on the sheet P, the first folding operation in which the sheet P is folded outside is performed at a position corresponding to one third (⅓) on one side of the entire length of the sheet P from the leading end of the sheet P in the sheet conveyance direction. Then, the second folding operation in which the sheet P is folded inside is performed at a position corresponding to one third (⅓) on the other side of the entire length of the sheet P. On the other hand, when the sheet folder unit 200 performs the letter fold-in operation on the sheet P, the first folding operation in which the sheet P is folded outside is performed at a position corresponding to two thirds (⅔) on one side of the entire length of the sheet P from the leading end of the sheet P in the sheet conveyance direction, and the second folding operation in which the sheet P is folded inside is performed at a position corresponding to one third (⅓) on the other side of the entire length of the sheet P.

The sheet bundle Q on which the second folding operation is performed is conveyed by the fifth sheet conveyor R5 to the downstream side in the sheet conveyance direction via the fifth sheet conveyance passage W5.

First Embodiment

A description is now given of the circulation conveyance control of the sheet P executed by the sheet folder unit 200, according to a first embodiment of the present disclosure.

As described above with reference to FIGS. 5 to 10, the circulation conveyance control according to the present embodiment corresponds to the control for circulating and conveying a plurality of sheets P conveyed into the circulation conveyance passage as the same conveyance passage at predetermined time intervals.

In other words, the circulation conveyance control according to the present embodiment is to overlay the preceding sheet P1 that has been conveyed and circulated in the sheet folder unit 200 and the following sheet P2 that is conveyed into the sheet folder unit 200 at the predetermined position (i.e., the sheet overlaying position) in the first sheet conveyance passage W1. When the overlapped sheets P (i.e., the sheet bundle Q) are conveyed from the first sheet conveyor R1 and circulated to be conveyed to the first sheet conveyor R1 again in the circulation conveyance as illustrated in FIGS. 7 to 10, the preceding sheet P1 precedes (projects from) the following sheet P2 due to the difference between the inner turning course and the outer turning course of the conveyance passages. In other words, the relative positions of the leading ends of the preceding sheet P1 and the following sheet P2 that are overlaid with each other at the sheet overlaying position are not aligned due to the circulation conveyance.

If the folding conveyance illustrated in FIGS. 10 to 14 is performed on the sheet bundle Q when the relative positions of the leading ends of the preceding sheet P1 and the following sheet P2 are not aligned, the fold is formed with the unaligned leading ends of the preceding sheet P1 and the following sheet P2. As a result of the sheet folding operation on the sheet bundle Q, the leading end of the sheet bundle Q is unaligned and displaced.

To prevent displacement of the relative positions of the leading ends of the preceding sheet P1 and the following sheet P2 due to the circulation conveyance, the sheet processing controller 210 causes the following sheet P2 to precede the preceding sheet P1 at the upstream side from the first sheet conveyor R1 in the sheet conveyance direction. As a result, the leading end of the sheet bundle Q is aligned when the sheet bundle Q comes to the step of the folding conveyance. In this case, the preceding amount (i.e., the projection amount) of the leading end of the following sheet P2 to the leading end of the preceding sheet P1 is determined in advance in consideration of the difference between the inner turning course and the outer turning course of the conveyance passages. With the predetermined preceding amount (i.e., the projection amount), the sheet processing controller 210 controls the following sheet P2 and the preceding sheet P1 to reach the nip region of the first sheet conveyor R1.

In this case, in consideration of the relative sheet conveyance speeds of the third sheet conveyor R3 for conveying the sheet P during the circulation conveyance and the first sheet conveyor R1 for conveying the sheet P where the first sheet conveyor R1 is temporarily stopped and resumed to perform the skew correction, it is required to maintain the constant preceding amount (i.e., the projection amount) of the leading end of the following sheet P2 to the leading end of the preceding sheet P1.

In other words, even if the sheet bundle Q is temporarily formed with the predetermined preceding amount at the sheet overlaying position, the relative sheet conveyance speeds of the first sheet conveyor R1 for conveying the sheet P and the third sheet conveyor R3 for conveying the sheet P change when the following sheet P2 reaches the first sheet conveyor R1 to receive the skew correction. The first sheet conveyor R1 stops rotating at the timing at which the leading end of the following sheet P2 reaches the nip region of the first sheet conveyor R1. When resuming the rotations of the first sheet conveyor R1, the sheet conveyance speed of the first sheet conveyor R1 for conveying the sheet P changes with time until the conveyance speed reaches the predetermined sheet conveyance speed. For this reason, the relative sheet conveyance speeds of the first sheet conveyor R1 for conveying the sheet P and the third sheet conveyor R3 for conveying the sheet P change.

In this case, the relative sheet conveyance speeds are not constant between the third sheet conveyor R3 for conveying the preceding sheet P1 toward the first sheet conveyor R1 in the circulation conveyance and the first sheet conveyor R1 for conveying the following sheet P2 where the first sheet conveyor R1 is temporarily stopped and resumed the rotations. As a result, the skew correction on the following sheet P2 results in a reduction in the preceding amount of the leading end of the following sheet P2 to the leading end of the preceding sheet P1.

The preceding amount of the leading end of the following sheet P2 when the preceding sheet P1 is overlaid with the following sheet P2 in the circulation conveyance is reduced due to the speed difference between the first sheet conveyor R1 and the third sheet conveyor R3. When this reduction amount is denoted as "M0", the reduction amount "M0" is calculated using Equation 1: $M0=S1\times T1-M1$. "M0" denotes a distance.

"S1" in Equation 1 denotes a sheet conveyance speed of the third sheet conveyor R3 for conveying the preceding sheet P1.

"T1" in Equation 1 denotes a time (i.e., the conveyance time) from when the first sheet conveyor R1 resumes the conveyance of the following sheet P2 to when the preceding sheet P1 reaches the first sheet conveyor R1.

Further, "M1" in Equation 1 denotes a conveyance distance in which the first sheet conveyor R1 conveys the following sheet P2 in the time corresponding to the time "T1". In other words, the conveyance distance "M1" corresponds to the distance in which the first sheet conveyor R1 conveys the following sheet P2 from when the following sheet P2 is temporarily stopped so that the first sheet conveyor R1 performs the skew correction on the following sheet P2 to when the first sheet conveyor R1 resumes and accelerates the rotations to the predetermined conveyance speed.

As described above, it is assumed that the conveyance of the preceding sheet P1 is resumed at the equal timing without depending on the conveyance speed of the following sheet P2 by the first sheet conveyor R1. In this case, the reduction amount "M0", which serves as the (reduction) amount in which the preceding amount of the position of the leading end of the following sheet P2 to the position of the leading end of the preceding sheet P1 is reduced, changes depending on the speed difference between the change in the sheet conveyance speed of the first sheet conveyor R1 at the stage of increase in speed of the first sheet conveyor R1 and the sheet conveyance speed of the third sheet conveyor R3 for conveying the preceding sheet P1.

In other words, to perform the skew correction, the conveyance of the following sheet P2 is resumed after being temporarily stopped. Due to this operation, the sheet conveyance speed of the first sheet conveyor R1 for conveying the following sheet P2 during the control in which the first sheet conveyor R1 is temporarily stopped and then is resumed becomes slower than the conveyance speed of the third sheet conveyor R3 for conveying the preceding sheet P1. Accordingly, when the sheet conveyance speed of the third sheet conveyor R3 for conveying the preceding sheet P1 stays unchanged (remains constant) regardless of the changes in the sheet conveyance speed of the first sheet conveyor R1 for conveying the following sheet P2, the sheet conveyance speed of the first sheet conveyor R1 for conveying the following sheet P2 becomes slower than the sheet conveyance speed of the third sheet conveyor R3 for conveying the preceding sheet P1. As a result, the preceding amount of the following sheet P2 to the preceding sheet P1 is reduced with respect to the predetermined set amount, and the conveyance control in which the reduction of the preceding amount is taken into consideration is to be executed.

As described above, the preceding amount that is formed before the sheet bundle Q is circulated in the circulation conveyance decreases whenever the circulation conveyance is performed due to the difference between the inner turning course and the outer turning course of the conveyance passages. The conveyance control of the first sheet conveyor R1 and the third sheet conveyor R3 is executed to obtain the preceding amount by taking this decrease into consideration. In this case, in order to further obtain the consistency in alignment of the leading ends of the sheets P, the sheet conveyance speed of the third sheet conveyor R3 for conveying the preceding sheet P1 is controlled in consideration of the reduction of the preceding amount (the reduction amount) due to the change of the relative sheet conveyance speeds of a plurality of sheet conveyors, as described above. In other words, the sheet conveyance speed of the third sheet conveyor R3 for conveying the preceding sheet P1 is varied to maintain the constant relative sheet conveyance speeds between the sheet conveyance speed of the first sheet conveyor R1 for conveying the following sheet P2 that changes due to the control for the skew correction on the following sheet P2 with the first sheet conveyor R1 and the sheet conveyance speed of the third sheet conveyor R3 for conveying the preceding sheet P1.

Figure 15:
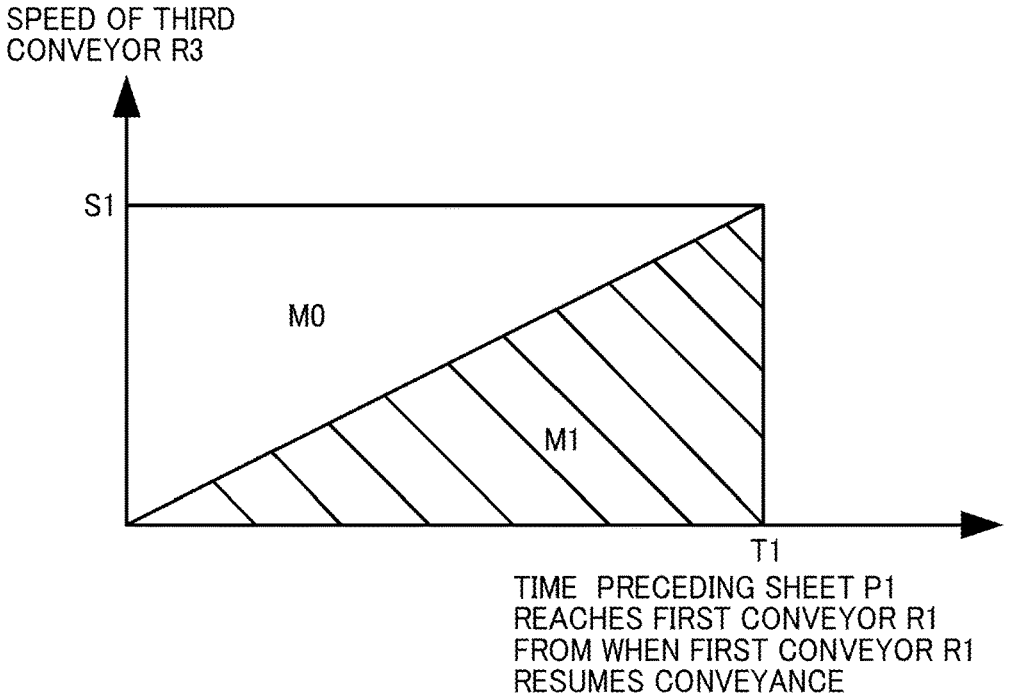
FIG. 15 is a conceptual diagram illustrating the variable control executed by a sheet processing controller on the sheet conveyance speed of a third sheet conveyor.

FIG. 15 is a conceptual diagram illustrating the variable control executed by the sheet processing controller 210 on the sheet conveyance speed of the third sheet conveyor R3.

In the graph of FIG. 15, the vertical axis indicates "S1" as the sheet conveyance speed of the third sheet conveyor R3. The horizontal axis indicates "T1" as the time from when the first sheet conveyor R1 resumes the conveyance of the following sheet P2 to when the preceding sheet P1 reaches the first sheet conveyor R1.

As illustrated in FIG. 15, the sheet processing controller 210 adjusts to decrease the sheet conveyance speed of the third sheet conveyor R3 so that the preceding amount of the following sheet P2 is the predetermined amount. By so doing, the reduction amount remains constant from when the first sheet conveyor R1 stops driving to when the first sheet conveyor R1 starts to resume.

Second Embodiment

A description is now given of the circulation conveyance control of the sheet P performed in the sheet folder unit 200, according to a second embodiment of the present disclosure. As described in the first embodiment, the timing at which the amount of displacement (i.e., the preceding amount) of the leading ends of the preceding sheet P1 and the following sheet P2 in the circulation conveyance is based on the timing at which the first sheet conveyor R1 resumes the conveyance.

Further, it is assumed in the first embodiment that the sheet conveyance speed of the third sheet conveyor R3 for conveying the preceding sheet P1 is constant. The sheet conveyance speed of the third sheet conveyor R3 for conveying the preceding sheet P1 may change. If the third sheet conveyor R3 increases or decreases the sheet conveyance speed after the first sheet conveyor R1 resumes the conveyance of the following sheet P2, the sheet conveyance speed is based on the sheet conveyance speed of the third sheet conveyor R3 for conveying the preceding sheet P1 when the first sheet conveyor R1 resumes the conveyance. For this reason, the above-described "S1" and "T1" come out of the target values.

To address this inconvenience, in the present embodiment, "M0" denotes a decrease distance (i.e., the reduction amount) that decreases when the third sheet conveyor R3 increases or decreases the conveyance speed after the conveyance of preceding sheet P1 has resumed. The distance "M0" is calculated with Equation 2: $M0=S2\times T2-M2$.

"S2" in Equation 2 denotes a sheet conveyance speed of the third sheet conveyor R3 for conveying the preceding sheet P1 when the first sheet conveyor R1 resumes the conveyance of the following sheet P2.

"T2" in Equation 2 denotes a time (i.e., the conveyance time) from when the first sheet conveyor R1 resumes the conveyance of the following sheet P2 to when the preceding sheet P1 reaches the first sheet conveyor R1.

Further, "M2" in Equation 2 denotes a conveyance distance in which the first sheet conveyor R1 conveys the following sheet P2 in the time corresponding to the time "T2".

Figure 16:
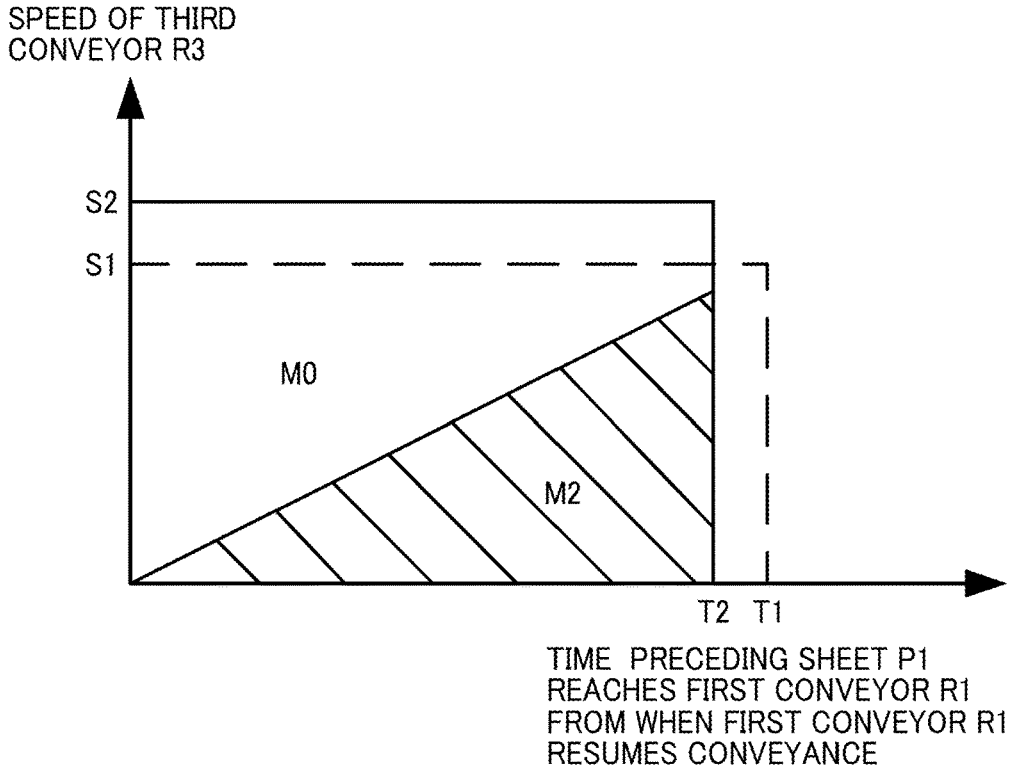
FIG. 16 is a conceptual diagram illustrating the variable control executed by the sheet processing controller on the sheet conveyance speed of the third sheet conveyor, according to the present embodiment.

FIG. 16 is a conceptual diagram illustrating the variable control executed by the sheet processing controller 210 on the sheet conveyance speed of the third sheet conveyor R3, according to the present embodiment.

In the graph of FIG. 16, the vertical axis indicates "S1" and "S2" each as the sheet conveyance speed of the third sheet conveyor R3. The horizontal axis indicates "T1" and "T2" each as the time from when the first sheet conveyor R1 resumes the conveyance of the following sheet P2 to when the preceding sheet P1 reaches the first sheet conveyor R1.

As illustrated in FIG. 16, the sheet processing controller 210 adjusts to decrease the sheet conveyance speed of the third sheet conveyor R3 in accordance with the sheet conveyance speed at the timing at which the first sheet conveyor R1 resumes the conveyance so that the preceding amount of the following sheet P2 is maintained to be the predetermined amount. By so doing, the reduction amount to be generated until when the first sheet conveyor R1 starts to resume is constant.

Third Embodiment

A description is now given of the circulation conveyance control of the sheet P performed in the sheet folder unit 200, according to a third embodiment of the present disclosure. When the acceleration of the first sheet conveyor R1 is varied, the conveyance distance "M2" described in the second embodiment is also changed.

Figure 17:
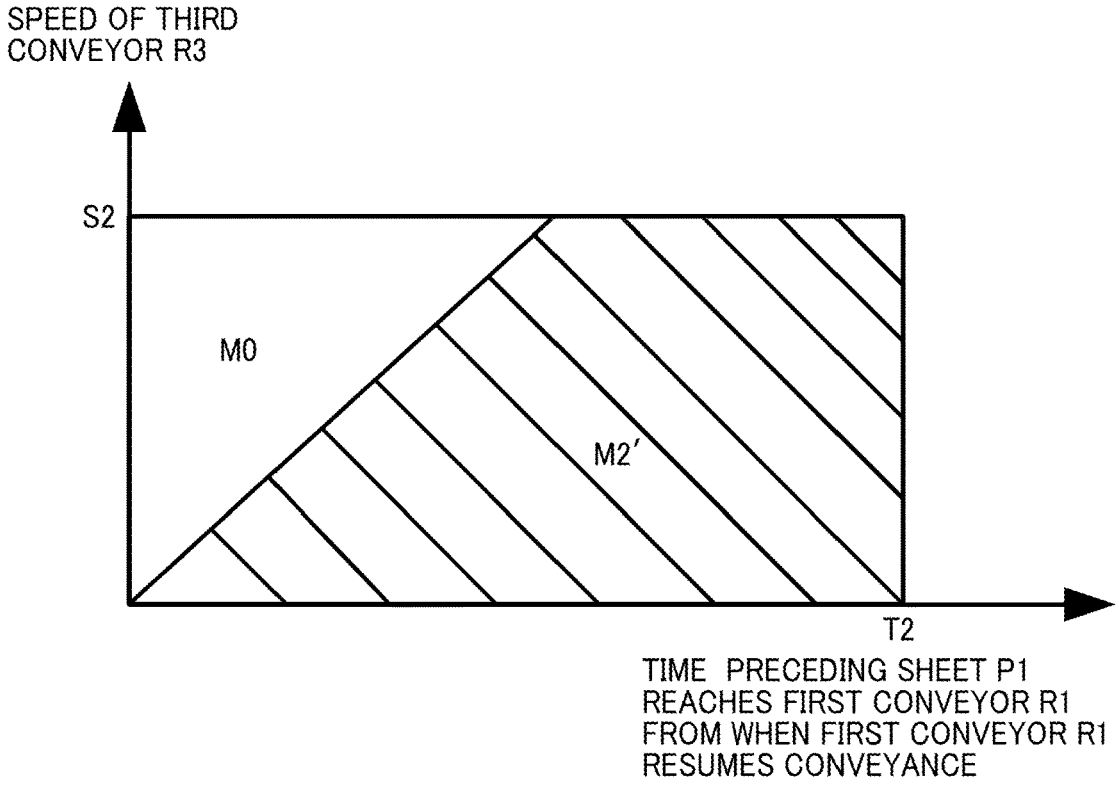
FIG. 17 is a conceptual diagram illustrating the variable control executed by the sheet processing controller on the sheet conveyance speed of the third sheet conveyor, according to the present embodiment.

FIG. 17 is a conceptual diagram illustrating the variable control of the conveyance speed of the sheet by the third sheet conveyor R3 executed in the sheet processing controller 210 according to the present embodiment.

As illustrated in the graph of FIG. 17, when the acceleration of the first sheet conveyor R1 are increased, the value of the distance of conveyance "M2" is increased ("M2'" in FIG. 17), while the value of the distance "M0" as the reduction amount is decreased.

Figure 18:
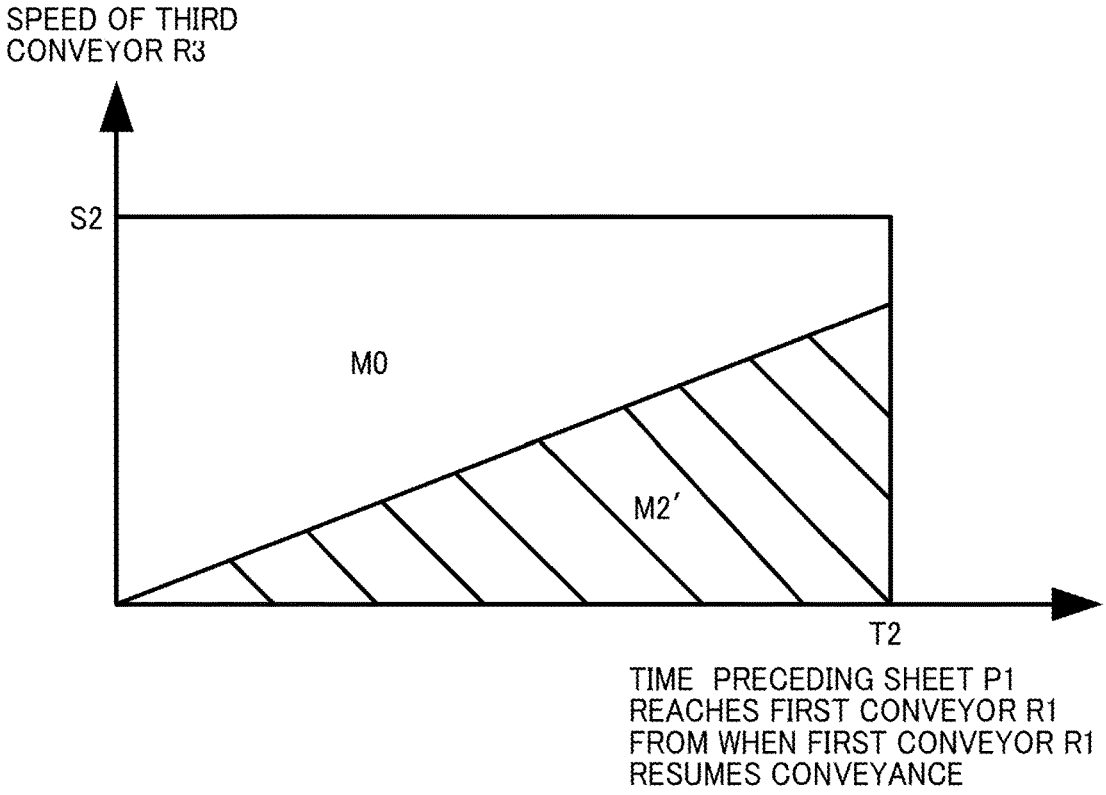
FIG. 18 is a conceptual diagram illustrating the variable control executed by the sheet processing controller on the sheet conveyance speed of the third sheet conveyor, according to the present embodiment.

FIG. 18 is a conceptual diagram illustrating the variable control of the conveyance speed of the sheet by the third sheet conveyor R3 executed in the sheet processing controller 210 according to the present embodiment.

As illustrated in the graph of FIG. 18, when the acceleration of the first sheet conveyor R1 are decreased, the value of the distance of conveyance "M2" is decreased ("M2'" in FIG. 18), while the value of the distance "M0" as the reduction amount is increased.

In other words, as illustrated in FIGS. 17 and 18, the acceleration of the first sheet conveyor R1 varies to maintain the amount (i.e., the preceding amount) to precede the following sheet P2 as the constant amount.

Fourth Embodiment

A description is now given of the circulation conveyance control of the sheet P performed in the sheet folder unit 200, according to a fourth embodiment of the present disclosure.

When the first sheet conveyor R1 is in the reverse rotation while the following sheet P2 contacts the nip region of the first sheet conveyor R1 for the skew correction of the sheet P, the first sheet conveyor R1 needs to be stopped temporarily after the following sheet P2 contacts the first sheet conveyor R1. The term "reverse rotation" indicates the rotations of the first sheet conveyor R1 in the reverse direction while the forward rotation indicates the rotations of the first sheet conveyor R1 in the direction in which the first sheet conveyor R1 conveys the sheet P toward the downstream side.

As described above, since the third sheet conveyor R3 is driven even when the first sheet conveyor R1 is stopped, the preceding sheet P1 continues to approach the nip region of the first sheet conveyor R1 even when the following sheet P2 is stopped. For this reason, the distance of reduction (in other words, the reduction amount) in which the preceding amount generated at the sheet overlaying position is reduced due to the speed difference between the following sheet P2 and the preceding sheet P1 is denoted as "M0", and the reduction amount "M0" is calculated using Equation 3: $M0=S2\times T1-M3$.

"S2" in Equation 3 denotes a sheet conveyance speed of the third sheet conveyor R3 for conveying the preceding sheet P1 when the first sheet conveyor R1 resumes the conveyance of the following sheet P2.

"T2" in Equation 3 denotes a time (i.e., the conveyance time) from when the first sheet conveyor R1 resumes the conveyance of the following sheet P2 to when the preceding sheet P1 reaches the first sheet conveyor R1.

Further, "M3" in Equation 3 denotes a conveyance distance in which the first sheet conveyor R1 conveys the following sheet P2 in the time corresponding to the time of the time "T2"-the time "T3". The time T3 is a time from when the first sheet conveyor R1 rotates in the reverse direction to when the first sheet conveyor R1 is stopped.

Figure 19:
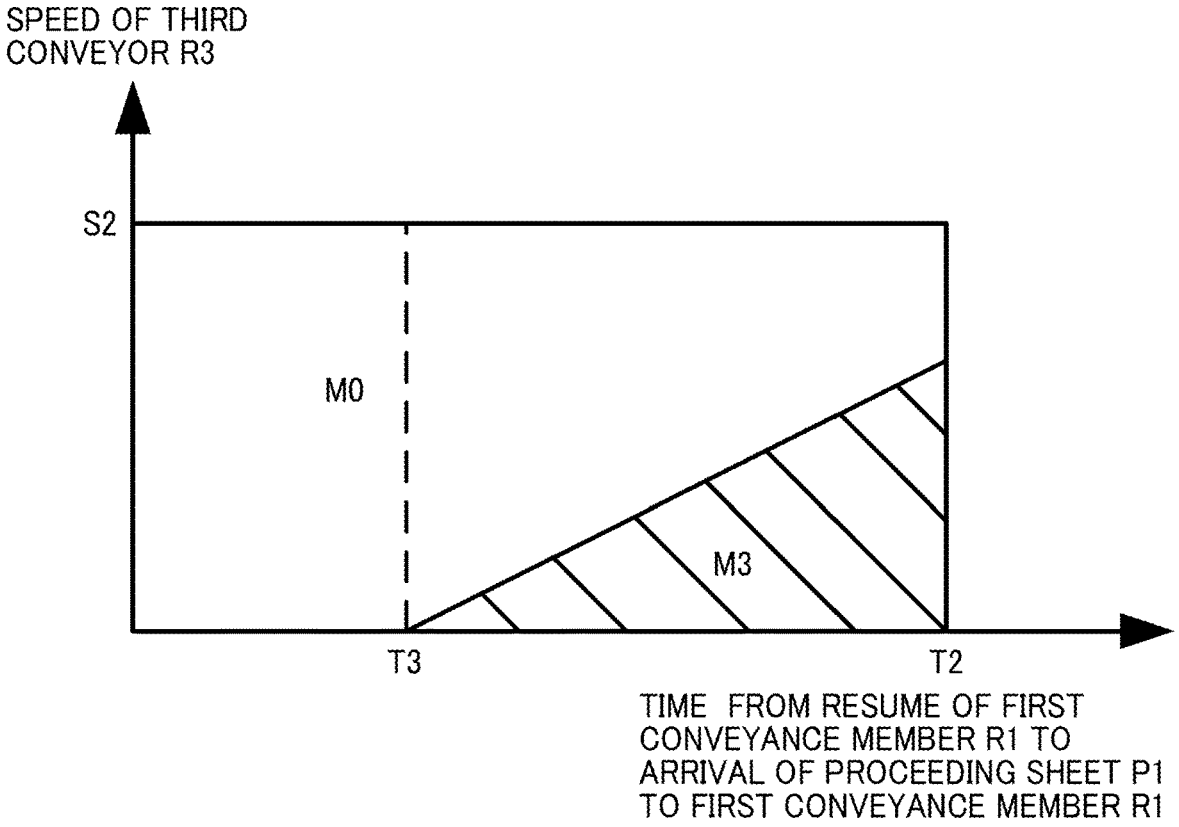
FIG. 19 is a conceptual diagram illustrating the variable control executed by the sheet processing controller on the sheet conveyance speed of the third sheet conveyor, according to the present embodiment.

FIG. 19 is a conceptual diagram illustrating the variable control executed by the sheet processing controller 210 on the sheet conveyance speed of the third sheet conveyor R3, according to the present embodiment.

As illustrated in the graph of FIG. 19, since the value of the conveyance distance M3 is smaller than the value of the conveyance distance M2, the distance "M0" increases.

The time T3 varies depending on the speed of the first sheet conveyor R1 in the reverse rotation and the deceleration of the first sheet conveyor R1. When the following sheet P2 is brought to contact the nip region of the first sheet conveyor R1, the distance "M0" as the reduction amount varies between the case when the first sheet conveyor R1 is rotated in the reverse direction and the case when the first sheet conveyor R1 is stopped. By so doing, the constant preceding amount of the following sheet P2 can be maintained.

Figure 20:
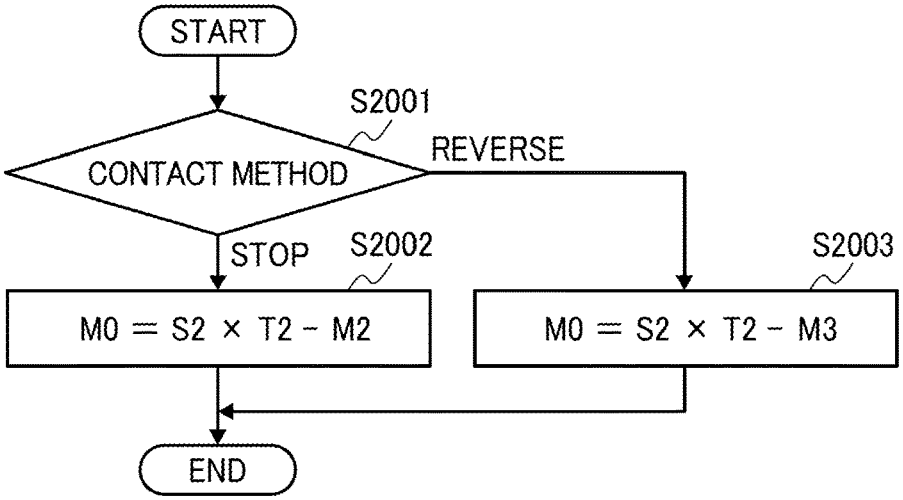
FIG. 20 is a flow chart of the process included in the circulation conveyance control executed by the sheet processing controller of the sheet folder unit according to the present embodiment.

FIG. 20 is a flowchart of the process included in the circulation conveyance control executed by the sheet processing controller 210 according to the present embodiment.

This process is to calculate the distance "M0" as the reduction amount.

First, the sheet processing controller 210 determines a contact method of contacting the following sheet P2 to the first sheet conveyor R1 (step S2001).

When the contact method is "STOP" indicating that the first sheet conveyor R1 is stopped, the distance "M0" is calculated based on Equation 2 described above (step S2002).

When the contact method is "REVERSE" indicating that the first sheet conveyor R1 is rotated in the reverse direction, the distance "M0" is calculated based on Equation 3 described above (step S2003).

As described above, according to the circulation conveyance control in the sheet processing controller 210 according to the present embodiment, even when the skew correction in which the posture of conveyance of the sheet P is corrected to enhance the consistency in alignment of the sheet P has different methods, the preceding amount to prevent the displacement of the leading end of the sheet P generated due to the circulation conveyance can be constant.

Aspects of the Present Disclosure

By way of example, aspects of the present disclosure are given below.

Aspect 1.

In Aspect 1, a sheet processing apparatus includes a sheet conveyance passage to receive a sheet before a following sheet at a given time interval, a sheet circulation passage in which the sheet is circulated to be overlaid with the following sheet in the sheet conveyance passage, the sheet circulation passage including at least a first sheet conveyance passage, a second sheet conveyance passage, and a third sheet conveyance passage, a first conveyor disposed in the sheet circulation passage to stop the sheet temporarily and convey the sheet to a downstream side in a sheet conveyance direction in which the sheet is conveyed, to correct a conveyance position of the sheet with respect to the sheet conveyance direction in the first sheet conveyance passage, a second conveyor disposed in the sheet circulation passage to receive the sheet conveyed by the first conveyor and convey the sheet along the second sheet conveyance passage, a third conveyor disposed in the sheet circulation passage to receive the sheet conveyed by the second conveyor and convey the sheet along the third sheet conveyance passage to circulate the sheet to the first sheet conveyance passage, and circuitry to control sheet conveyance speeds of the first conveyor, the second conveyor, and the third conveyor to convey the sheet.

The circuitry is to circulate the sheet in the sheet circulation passage to overlay the sheet with the following sheet conveyed after the sheet in the first sheet conveyance passage, at an upstream position of the first sheet conveyance passage, and adjust the sheet conveyance speed of the third conveyor to circulate the sheet, based on a reduction amount that is obtained when a preceding amount of a leading end of the following sheet with respect to a leading end of the sheet is reduced while the following sheet is temporarily stopped due to a temporary stop of the first conveyor.

Aspect 2.

In Aspect 2 according to Aspect 1, the circuitry is to adjust the sheet conveyance speed of the third conveyor to convey the sheet when the sheet reaches the first conveyor.

Aspect 3.

In Aspect 3 according to Aspect 1 or Aspect 2, the circuitry is to adjust the sheet conveyance speed of the third conveyor based on an acceleration of the first conveyor at which the first conveyor resumes a conveyance of the following sheet.

Aspect 4.

In Aspect 4 according to any one of Aspects 1 to 3, the circuitry is to adjust the sheet conveyance speed of the third conveyor based on a time from when the first conveyor rotates in a reverse direction to when the first conveyor rotates in the reverse direction opposite to a forward direction in which the sheet is conveyed toward the downstream side in the sheet conveyance direction and stops when the sheet contacts the first conveyor.

Aspect 5.

In Aspect 5 according to any one of Aspects 1 to 4, a time ranging from when the first conveyor resumes a conveyance of the following sheet to when the sheet reaches the first conveyor is a sheet conveyance time, and a distance in which the first conveyor conveys the following sheet to the downstream side in the sheet conveyance direction during the sheet conveyance time is a sheet conveyance distance. The circuitry is to adjust the sheet conveyance speed of the third conveyor based on the sheet conveyance time and the sheet conveyance distance so that the preceding amount of the leading end of the sheet with respect to the leading end of the following sheet in the sheet conveyance direction at a point at which the sheet and the following sheet overlaid with each other in the first sheet conveyance passage pass through the first conveyor reaches a given amount.

Aspect 6.

In Aspect 6, an image forming apparatus includes an image former to form an image on a sheet, and the sheet processing apparatus according to Aspects 1 to 5 to perform a post-processing operation on the sheet.

Aspect 7.

In Aspect 7, an image forming system includes an image forming apparatus including an image former configured to form an image on a sheet, and the sheet processing apparatus according to Aspects 1 to 6 coupled to the image forming apparatus.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet processing apparatus comprising:

a sheet conveyance passage configured to receive a sheet before a following sheet at a given time interval, the sheet conveyance passage including a sheet circulation passage in which the sheet is circulated to be overlaid with the following sheet, the sheet circulation passage including at least a first passage, a second passage, and a third passage;

a first roller disposed in the sheet circulation passage and configured to stop the sheet temporarily and convey the sheet to a downstream side in a sheet conveyance direction in which the sheet is conveyed, to correct a conveyance position of the sheet with respect to the sheet conveyance direction in the first passage;

a second roller disposed in the sheet circulation passage and configured to receive the sheet conveyed by the first roller and convey the sheet along the second passage;

a third roller disposed in the sheet circulation passage and configured to receive the sheet conveyed by the second roller and convey the sheet along the third passage to circulate the sheet to the first passage; and circuitry configured to control sheet conveyance speeds of the first roller, the second roller, and the third roller to convey the sheet, wherein the circuitry is configured to:

circulate the sheet in the sheet circulation passage to overlay the sheet with the following sheet conveyed after the sheet in the first passage, at an upstream position of the first passage; and adjust the sheet conveyance speed of the third roller to circulate the sheet, based on a reduction amount that is obtained when a preceding amount of a leading end of the following sheet with respect to a leading end of the sheet is reduced while the following sheet is temporarily stopped due to a temporary stop of the first roller.

2. The sheet processing apparatus according to claim 1, wherein the circuitry is configured to adjust the sheet conveyance speed of the third roller to convey the sheet when the sheet reaches the first roller.

3. The sheet processing apparatus according to claim 2, wherein the circuitry is configured to adjust the sheet conveyance speed of the third roller based on an acceleration of the first roller at which the first roller resumes a conveyance of the following sheet.

4. The sheet processing apparatus according to claim 2, wherein the circuitry is configured to adjust the sheet conveyance speed of the third roller based on a time from when the first roller rotates in a reverse direction to when the first roller rotates in the reverse direction opposite to a forward direction in which the sheet is conveyed toward the downstream side in the sheet conveyance direction and stops when the sheet contacts the first roller.

5. The sheet processing apparatus according to claim 1, wherein a time ranging from when the first roller resumes a conveyance of the following sheet to when the sheet reaches the first roller is a sheet conveyance time, wherein a distance in which the first roller conveys the following sheet to the downstream side in the sheet conveyance direction during the sheet conveyance time is a sheet conveyance distance, and wherein the circuitry is configured to adjust the sheet conveyance speed of the third roller based on the sheet conveyance time and the sheet conveyance distance so that the preceding amount of the leading end of the sheet with respect to the leading end of the following sheet in the sheet conveyance direction at a point at which the sheet and the following sheet overlaid with each other in the first passage pass through the first roller reaches a given amount.

6. An image forming apparatus comprising:

a printer configured to form an image on a sheet; and the sheet processing apparatus according to claim 1 configured to perform a post-processing operation on the sheet.

7. An image forming system comprising:

an image forming apparatus including a printer configured to form an image on a sheet; and the sheet processing apparatus according to claim 1 coupled to the image forming apparatus.

* * * * *